US007610005B2

(12) United States Patent
Ide

(10) Patent No.: US 7,610,005 B2
(45) Date of Patent: Oct. 27, 2009

(54) FIXING APPARATUS AND IMAGE FORMING APPARATUS HAVING THE SAME, INCLUDING A PROPINQUITY/SEPARATION MECHANISM FOR MOVING A FIXING ROLLER CLEANER IN RELATION TO FIXING ROLLERS

(75) Inventor: Atsushi Ide, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/199,469

(22) Filed: Aug. 8, 2005

(65) Prior Publication Data

US 2006/0029442 A1 Feb. 9, 2006

(30) Foreign Application Priority Data

Aug. 9, 2004 (JP) ..... 2004-232602

(51) Int. Cl.
*G03G 15/20* (2006.01)

(52) U.S. Cl. ..... 399/327

(58) Field of Classification Search ..... 399/327, 399/326

See application file for complete search history.

(56) References Cited

U.S. PATENT DOCUMENTS

| | | | | |
|---|---|---|---|---|
| 5,045,890 | A * | 9/1991 | DeBolt et al. | 399/325 |
| 5,978,640 | A * | 11/1999 | Segawa | 399/327 |
| 6,173,136 | B1 * | 1/2001 | Fuchiwaki et al. | 399/67 |
| 6,377,774 | B1 * | 4/2002 | Maul et al. | 399/325 |

FOREIGN PATENT DOCUMENTS

| | | | |
|---|---|---|---|
| JP | 57068883 | A * | 4/1982 |
| JP | 58018664 | A * | 2/1983 |
| JP | 58132770 | A * | 8/1983 |
| JP | 01265284 | A * | 10/1989 |
| JP | 04-056884 | | 2/1992 |
| JP | 05127559 | A * | 5/1993 |
| JP | 07230229 | A * | 8/1995 |
| JP | 08-286547 | | 11/1996 |
| JP | 09-022215 | | 1/1997 |
| JP | 2000242128 | A * | 9/2000 |
| JP | 2001-083830 | | 3/2001 |
| JP | 2003-107952 | | 4/2003 |
| JP | 2003233265 | A * | 8/2003 |

OTHER PUBLICATIONS

Computer translation of applicant's cited reference to Iijima (JP08-286547a).*

* cited by examiner

*Primary Examiner*—Quana M Grainger
(74) *Attorney, Agent, or Firm*—Renner, Otto, Boisselle & Sklar, LLP

(57) ABSTRACT

A fixing apparatus for fusing and fixing an unfixed developer by heating/pressurizing a recording medium on which an image of the unfixed developer is formed, includes a fixing roller cleaning unit for cleaning surfaces of fixing rollers, and a propinquity/separation mechanism for moving the fixing roller cleaning unit close to and away from the fixing roller. The fixing apparatus operates the propinquity/separation mechanism so as to make the fixing roller cleaning unit contact the fixing roller when a temperature of the fixing roller becomes equal to or higher than a softening temperature of a developer. The fixing apparatus operates the propinquity/separation mechanism so as to move the fixing roller cleaning unit away from the fixing roller when a temperature of the fixing roller becomes lower than the softening temperature of the developer.

1 Claim, 12 Drawing Sheets

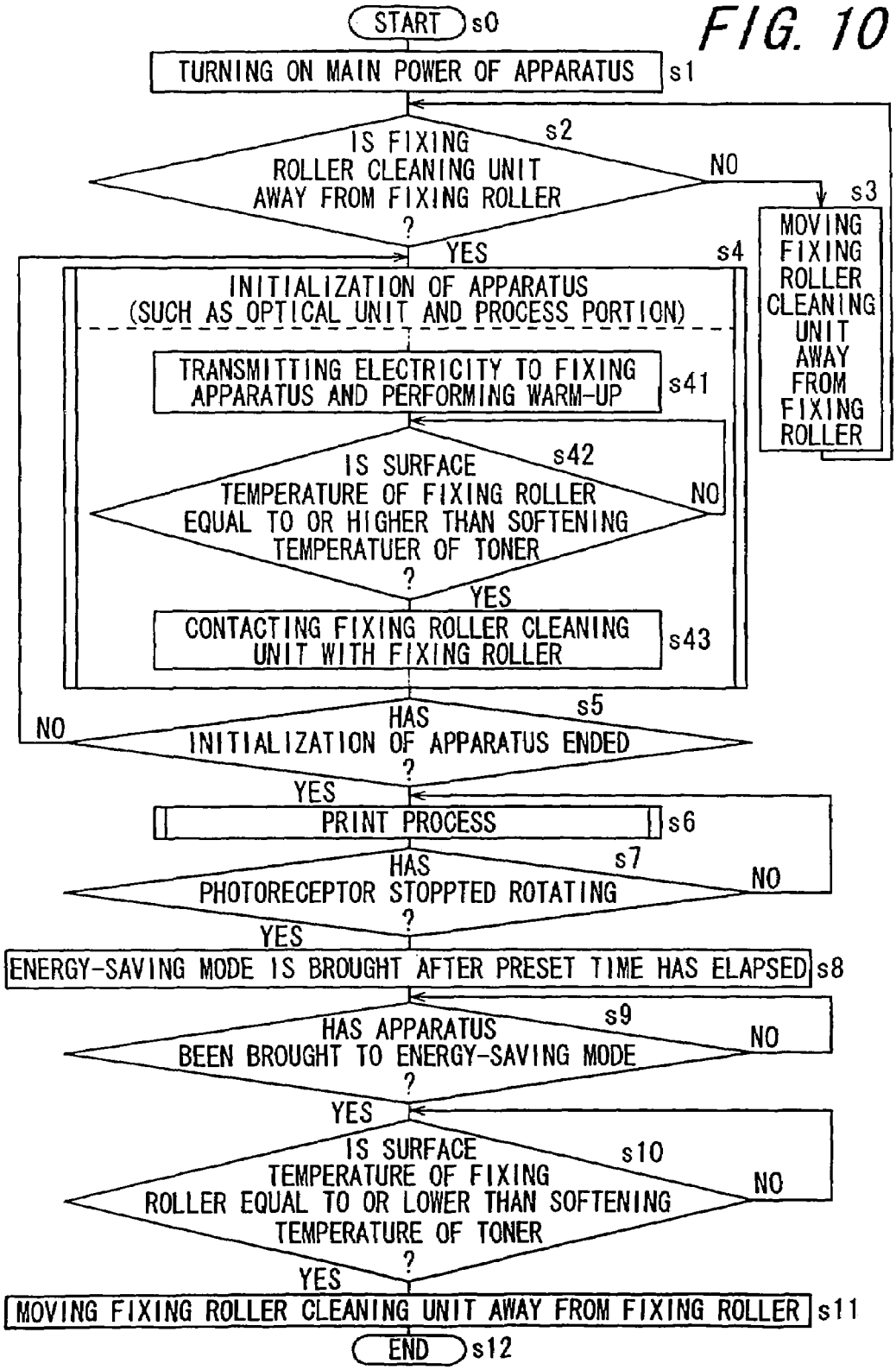
FIG. 10
START
s0
TURNING ON MAIN POWER OF APPARATUS
s1
IS FIXING ROLLER CLEANING UNIT AWAY FROM FIXING ROLLER ?
s2
NO
s3
MOVING FIXING ROLLER CLEANING UNIT AWAY FROM FIXING ROLLER
YES
s4
INITIALIZATION OF APPARATUS (SUCH AS OPTICAL UNIT AND PROCESS PORTION)
TRANSMITTING ELECTRICITY TO FIXING APPARATUS AND PERFORMING WARM-UP
s41
IS SURFACE TEMPERATURE OF FIXING ROLLER EQUAL TO OR HIGHER THAN SOFTENING TEMPERATUER OF TONER ?
s42
NO
YES
CONTACTING FIXING ROLLER CLEANING UNIT WITH FIXING ROLLER
s43
HAS INITIALIZATION OF APPARATUS ENDED ?
s5
NO
YES
PRINT PROCESS
s6
HAS PHOTORECEPTOR STOPPTED ROTATING ?
s7
NO
YES
ENERGY-SAVING MODE IS BROUGHT AFTER PRESET TIME HAS ELAPSED
s8
HAS APPARATUS BEEN BROUGHT TO ENERGY-SAVING MODE ?
s9
NO
YES
IS SURFACE TEMPERATURE OF FIXING ROLLER EQUAL TO OR LOWER THAN SOFTENING TEMPERATURE OF TONER ?
s10
NO
YES
MOVING FIXING ROLLER CLEANING UNIT AWAY FROM FIXING ROLLER
s11
END
s12

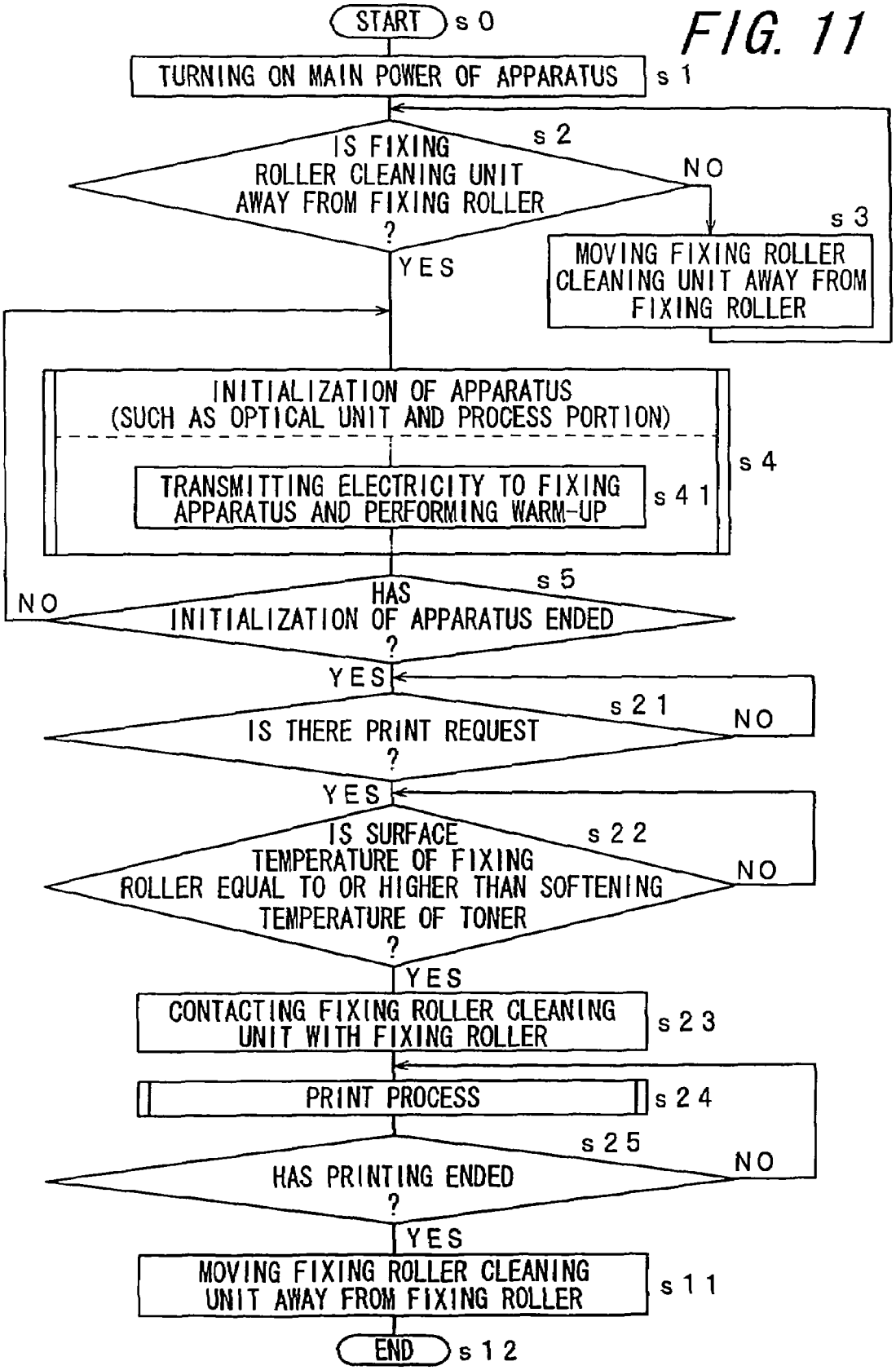
FIG. 11
START
s 0
TURNING ON MAIN POWER OF APPARATUS
s 1
IS FIXING ROLLER CLEANING UNIT AWAY FROM FIXING ROLLER ?
s 2
NO
YES
MOVING FIXING ROLLER CLEANING UNIT AWAY FROM FIXING ROLLER
s 3
INITIALIZATION OF APPARATUS (SUCH AS OPTICAL UNIT AND PROCESS PORTION)
TRANSMITTING ELECTRICITY TO FIXING APPARATUS AND PERFORMING WARM-UP
s 4
s 4 1
HAS INITIALIZATION OF APPARATUS ENDED ?
s 5
NO
YES
IS THERE PRINT REQUEST ?
s 2 1
NO
YES
IS SURFACE TEMPERATURE OF FIXING ROLLER EQUAL TO OR HIGHER THAN SOFTENING TEMPERATURE OF TONER ?
s 2 2
NO
YES
CONTACTING FIXING ROLLER CLEANING UNIT WITH FIXING ROLLER
s 2 3
PRINT PROCESS
s 2 4
HAS PRINTING ENDED ?
s 2 5
NO
YES
MOVING FIXING ROLLER CLEANING UNIT AWAY FROM FIXING ROLLER
s 1 1
END
s 1 2

FIXING APPARATUS AND IMAGE FORMING APPARATUS HAVING THE SAME, INCLUDING A PROPINQUITY/SEPARATION MECHANISM FOR MOVING A FIXING ROLLER CLEANER IN RELATION TO FIXING ROLLERS

BACKGROUND OF THE INVENTION

1. Field of the Invention

The present invention relates to a fixing apparatus preferably for use in an electrophotographic image forming apparatus, and to an image forming apparatus having the same.

2. Description of the Related Art

In an image formation using an electrophotographic system, a photoreceptor charged with uniform electric potential is exposed to light in accordance with image information so that an electrostatic latent image is formed. The formed electrostatic latent image is developed by a developer so as to be visualized. The visualized image is transferred on a recording paper or the like, and the transferred developer on the recording paper is made to be fixed so as to form a solid recording image.

The fixing apparatus used for such image formation, is generally composed of a heating roller and a pressure roller, which are such configured that in passing the recording paper on which the developer for forming a visualized image through a pressure contact region (hereinafter referred to as a nip section) of the heating roller and the pressure roller which is formed by pressing the pressure roller against the heating roller, unfixed developer is fused and fixed by heating of the heating roller and pressing of the pressure roller.

During a fixing operation in the fixing apparatus, there sometimes occurs a so-called hot offset that the developer fused on the nip section of the both rollers is not all fixed on the recording paper, but a part of the developer is attached to a surface of the roller. For instance, the developer attached to the heating roller is transferred on a portion which should be properly a white base, on a recording paper on which the developer is to be subsequently fixed, with the result that an image defect is made to occur.

Moreover, on the pressure roller, the developer which has already fixed to a back surface of the conveyed recording paper, for instance as in a case of duplex print, is sometimes fused again by heat in passing through the nip section and a part of the developer is transferred and attached to the pressure roller. The developer thus attached to the pressure roller may cause the image defect and further, may cause a soil of the back surface of the recording paper.

The image defect caused by the hot offset in the fixing apparatus sometimes remains, in a case of black-and-white print, mere defects such as a fog in a white base of a formed image, a soil on the back surface of the recording paper, or the like in a tolerable range. However, in a case of full-color print, since a developer having a color different from a prescribed one is transferred from the both rollers, there often occur practically intolerable defects.

As a related art for solving such a problem, there is an apparatus having fixing roller cleaning means on the both rollers provided in a fixing apparatus (refer to Japanese Unexamined Patent Publication JP-A 2003-107952).

FIG. 12 is a schematic view showing a configuration of fixing roller cleaning means 1 provided in a related art fixing apparatus. FIG. 12 illustrates the fixing roller cleaning means 1 provided on a heating roller 2 in the fixing apparatus.

The fixing roller cleaning means 1 comprises a feeding roller 4 for feeding a belt-shaped cleaning member 3 which has been previously rolled up, a winding roller 5 for taking up the cleaning member 3 fed from the feeding roller 4, and a pressure-contact roller 6 (also referred to as a web pressure-contact roller) provided between the feeding roller 4 and the winding roller 5 so as to press the cleaning member 3 on the heating roller 2.

The fixing roller cleaning means 1 presses the cleaning member 3 on the heating roller 2 which is rotated in an arrow sign 7 direction in a state where the winding roller 5, the feeding roller 4, and the pressure-contact roller 6 are made to be at rest without being rotated so that the heating roller 2 and the cleaning member 3 are made to be slidingly scrubbed. By so doing, a developer 8*a* attached in a fused state to an outer circumferential surface of the heating roller 2 is removed and the removed developer 8*b* is accumulated, still in a substantially fused state, in a gap formed by the cleaning member 3 located between the pressure-contact roller 6 and the winding roller 5, and the surface of the heating roller 2.

When the developer 8*b* accumulated in the gap reaches a certain amount level, the fixing roller cleaning means 1 operates the winding roller 5 for take-up in an arrow sign 9 direction so as to take up the cleaning member 3 only by a predetermined length, with the result that the developer 8*b* is made to detach from the surface of the heating roller 2 in a state where the developer 8*b* is attached to the cleaning member 3.

The related art fixing roller cleaning means 1 can prevent the hot offset by cleaning the developer on the surface of the fixing roller. However, the following problems arise because the fixing roller cleaning means 1 is provided in a state of being constantly in contact with the fixing roller.

The fixing apparatus having the fixing roller cleaning means 1 is generally mounted on an electrophotographic image forming apparatus to be operated. When the image forming apparatus executes an image forming operation, the temperature of the fixing roller rises up to a predetermined fixing temperature. However, the image forming operation is not a nonstop and successive motion, but an intermittent operation. Accordingly, when the image forming operation is not in execution, the image forming apparatus becomes a state of low-power consumption, that is so-called energy-saving mode, or a shut off mode indicating a state where the apparatus itself is turned off. In the energy-saving mode, a temperature of the fixing roller of the fixing apparatus declines down to a relatively low temperature, that is a softening temperature of the developer or a temperature lower than the softening temperature. In the shut off mode, the temperature of the fixing roller of the fixing apparatus declines down to a room temperature which is an environmental temperature.

Consequently, when the image forming operation is not in execution, a temperature of the developer 8*b* on the fixing roller, which is captured by the cleaning member 3 also declines down to a temperature or a temperature lower than the softening temperature. When the temperature of the developer 8*b* thus declines down to a temperature lower than the softening temperature, the developer 8*b* becomes solidified. Among the developers, a black developer contains carbon and therefore, it becomes hard when solidified.

In a state where such a solidified and hard developer exists between the fixing roller and the cleaning member 3, for instance, a power source of the apparatus is turned on and the fixing roller starts to rotate until its temperature rises up to the predetermined fixing temperature. At this time, the surface of the fixing roller is slidingly scrubbed by the solidified developer, with the result that the surface of the fixing roller is damaged. When fixing is conducted by use of the fixing roller having a scratch on the surface thereof, there arises a problem that uneven fixing occurs on the formed image.

SUMMARY OF THE INVENTION

An object of the invention is to provide a fixing apparatus capable of preventing a fixing roller from being damaged by moving fixing roller cleaning means away from the fixing roller (a heating roller or a pressure roller) except during execution of fixing operation, and an image forming apparatus having the fixing apparatus.

The invention provides a fixing apparatus for fusing and fixing an unfixed developer onto a recording medium, comprising:

fixing rollers which form a pair of rotators, a recording medium on which an image of an unfixed developer is formed being passed through a pressure contact section formed by the fixing rollers;

fixing roller cleaning means for cleaning at least either surface of the fixing rollers; and propinquity/separation means for moving the fixing roller cleaning means close to and away from the fixing rollers.

Further, in the invention, it is preferable that the fixing apparatus further comprises a temperature sensor for detecting a temperature of the fixing roller, and the propinquity/separation means moves the fixing roller cleaning means close to and away from the fixing roller in accordance with a detected output of the temperature sensor.

Further, in the invention, it is preferable that, when a temperature detected by the temperature sensor is equal to or higher than a predetermined boundary temperature, the propinquity/separation means makes the fixing roller cleaning means contact the fixing rollers in accordance with the detected output of the temperature sensor.

Further, in the invention, it is preferable that the boundary temperature is a softening temperature of a developer.

Further, in the invention, it is preferable that the boundary temperature is a predetermined fixing temperature at which a rising temperature of the fixing roller is targeted in order to fix the unfixed developer on the recording medium.

Further, in the invention, it is preferable that the fixing roller cleaning means comprises:

a belt-shaped cleaning member provided so as to contact at least either of the fixing rollers, for cleaning a surface of the fixing roller;

a pressure-contact roller provided so as to press the cleaning member on the fixing roller which is in contact with the cleaning member;

a feeding roller for feeding the belt-shaped cleaning member which has been rolled up; and a winding roller for taking up the cleaning member which has been fed from the feeding roller so as to contact the fixing roller, and then cleaned the surface of the fixing roller.

Further, in the invention, it is preferable that the fixing roller cleaning means comprises guide rollers respectively provided between the feeding roller and the pressure-contact roller, and between the pressure-contact roller and the winding roller, so as to contact the cleaning member.

Further, in the invention, it is preferable that the fixing roller cleaning means further comprises developer removing means for removing a developer existent on a surface of the to-be-taken-up cleaning member provided on a periphery of the winding roller.

Further, in the invention, it is preferable that the propinquity/separation means comprises:

a supporting member for supporting the fixing roller cleaning means; and a propinquity/separation driving portion for moving the supporting member so as to be close to and away from the fixing roller.

Further, the invention provides an image forming apparatus for forming an image in electrophotography, comprising the fixing apparatus.

Further, in the invention it is preferable that the image forming apparatus further comprises:

a photoreceptor exposed to light in accordance with image information so as to form an electrostatic latent image thereon;

photoreceptor rotation detecting means for detecting whether the photoreceptor rotates or not; and time counting means for counting a length of time that has elapsed since a halt of rotation of the photoreceptor detected by the photoreceptor rotation detecting means, wherein when a counted time by the time counting means becomes a predetermined value, the propinquity/separation means moves the fixing roller cleaning means away from the fixing roller.

Further, in the invention it is preferable that the image forming apparatus further comprises:

print request inputting means for inputting a print request serving as a starting command of an image forming operation;

print request detecting means for detecting an inputted print request; and print end detecting means for detecting end of the image forming operation, wherein in accordance with a detected output by the print request detecting means, the propinquity/separation means makes the fixing roller cleaning means contact the fixing roller, and in accordance with a detected output by the print end detecting means, the propinquity/separation means moves the fixing roller cleaning means away from the fixing roller.

According to the invention, the fixing apparatus comprises the fixing roller cleaning means for cleaning the fixing roller and moreover, the propinquity/separation means for moving the fixing roller cleaning means close to and away from the fixing rollers. With the result that the fixing roller cleaning means can be in contact with the fixing roller only during execution of a fixing operation, and the fixing roller cleaning means can be moved away from the fixing roller when the fixing operation is not executed. By so doing, it is possible to move the fixing roller cleaning means away from the fixing roller when the temperature of the fixing rollers is lower than the predetermined fixing temperature. Accordingly, a hard developer solidified between the fixing roller cleaning means and the fixing roller is made not to be slidingly scrubbed, and the fixing roller can be prevented from being damaged.

According to the invention, the propinquity/separation means can move the fixing roller cleaning means close to and away from the fixing roller in accordance with the detected output of the temperature sensor for detecting the temperature of the fixing roller. When the detected temperature is equal to or higher than the softening temperature or the predetermined fixing temperature of the developer selected as the predetermined boundary temperature, the propinquity/separation means makes the fixing roller cleaning means contact the fixing rollers. By so doing, the propinquity/separation means makes the fixing roller cleaning means contact the fixing roller only when the temperature the fixing rollers is at least equal to or higher than a developer softening temperature. Accordingly, the fixing roller is made not to be slidingly scrubbed by the solidified developer, and damage is prevented from occurring.

According to the invention, the fixing roller cleaning means comprises the belt-shaped cleaning member provided so as to contact the fixing rollers, for cleaning the surface of the fixing roller; the pressure-contact roller provided so as to press the cleaning member on the fixing roller; the feeding roller for feeding the cleaning member; and the winding roller for taking up the cleaning member which has cleaned the surface of the fixing roller. Accordingly, the cleaning member can be taken up and a clean cleaning member can be sequentially fed from the feeding roller as the developer cleaned away from the fixing roller is accumulated on the cleaning member. Consequently, the fixing roller can be cleaned for a long period of time without deteriorating a cleaning performance.

According to the invention, the fixing roller cleaning means comprises the guide rollers respectively provided between the feeding roller and the pressure-contact roller, and between the pressure-contact roller and the winding roller, so as to contact the cleaning member. Accordingly, it is made possible to add appropriate tension to the cleaning member. By so doing, even at a time of starting the take-up operation by the winding roller, the cleaning member is made not to be attached to the pressure-contact roller, with the result that there occurs no pulsation or the like caused by a rebound attributable to detachment of the cleaning member from the pressure-contact roller and therefore, the take-up operation can be smoothly carried out. Accordingly, the developer removed by the cleaning member is prevented from being detached from the cleaning member and attached again to the fixing roller at a time of starting the take-up operation so that an excellent cleaning performance is obtained.

According to the invention, the fixing roller cleaning means further comprises the developer removing means for removing the developer existent on the surface of the to-be-taken-up cleaning member provided on the periphery of the winding roller. Accordingly, the cleaning member itself can be made to recover to a clean state so that it is made possible to repeatedly use the cleaning member. Furthermore, by taking up the cleaning member after cleaning, it is possible to correctly obtain a taken-up diameter as designed in dependence upon a thickness of the cleaning member, with the result that a rotational speed control of the winding roller and the feeding roller can be made easy.

According to the invention, the propinquity/separation means comprises the supporting member for supporting the fixing roller cleaning means, and the propinquity/separation driving portion for moving the supporting member so as to be close to and away from the fixing roller. Accordingly, it is possible to integrally move the fixing roller cleaning means so that a moving mechanism is made simple.

According to the invention, the image forming apparatus for forming the image in electrophotography, comprises the aforementioned fixing apparatus. Accordingly, the fixing apparatus is excellent in durability, and fixing variation is prevented from occurring in a formed image.

According to the invention, the image forming apparatus can move the fixing roller cleaning means away from the fixing roller when a length of time that has elapsed since the halt of rotation of the photoreceptor becomes the predetermined value. By so doing, the fixing roller cleaning means is made to contact the fixing roller only during the fixing operation, whereas the fixing roller cleaning means can be made to move away from the fixing roller when the image forming apparatus is brought to be in a state which is set in accordance with the length of time that has elapsed since the halt of rotation of the photoreceptor. The state includes, for instance, an energy-saving mode indicating a standby state of image formation, where the apparatus has been initialized, or a shut off mode indicating a state where a main power of the apparatus is turned off so that only standby electricity is being supplied.

According to the invention, the image forming apparatus can make the fixing roller cleaning means contact the fixing roller only when a print process of the image forming operation is in execution, whereas the image forming apparatus can move the fixing roller cleaning means away from the fixing roller except during the execution of the image forming operation.

BRIEF DESCRIPTION OF THE DRAWINGS

Other and further objects, features, and advantages of the invention will be more explicit from the following detailed description taken with reference to the drawings wherein:

FIG. 10 is a flow chart for explaining an operational control over a propinquity/separation mechanism due to a control portion based on a length of time that has elapsed since a halt of rotation of a photoreceptor;

FIG. 11 is a flow chart for explaining an operational control over a propinquity/separation mechanism by a control portion based on a print process.

DETAILED DESCRIPTION OF THE PREFERRED EMBODIMENTS

Figure 1:
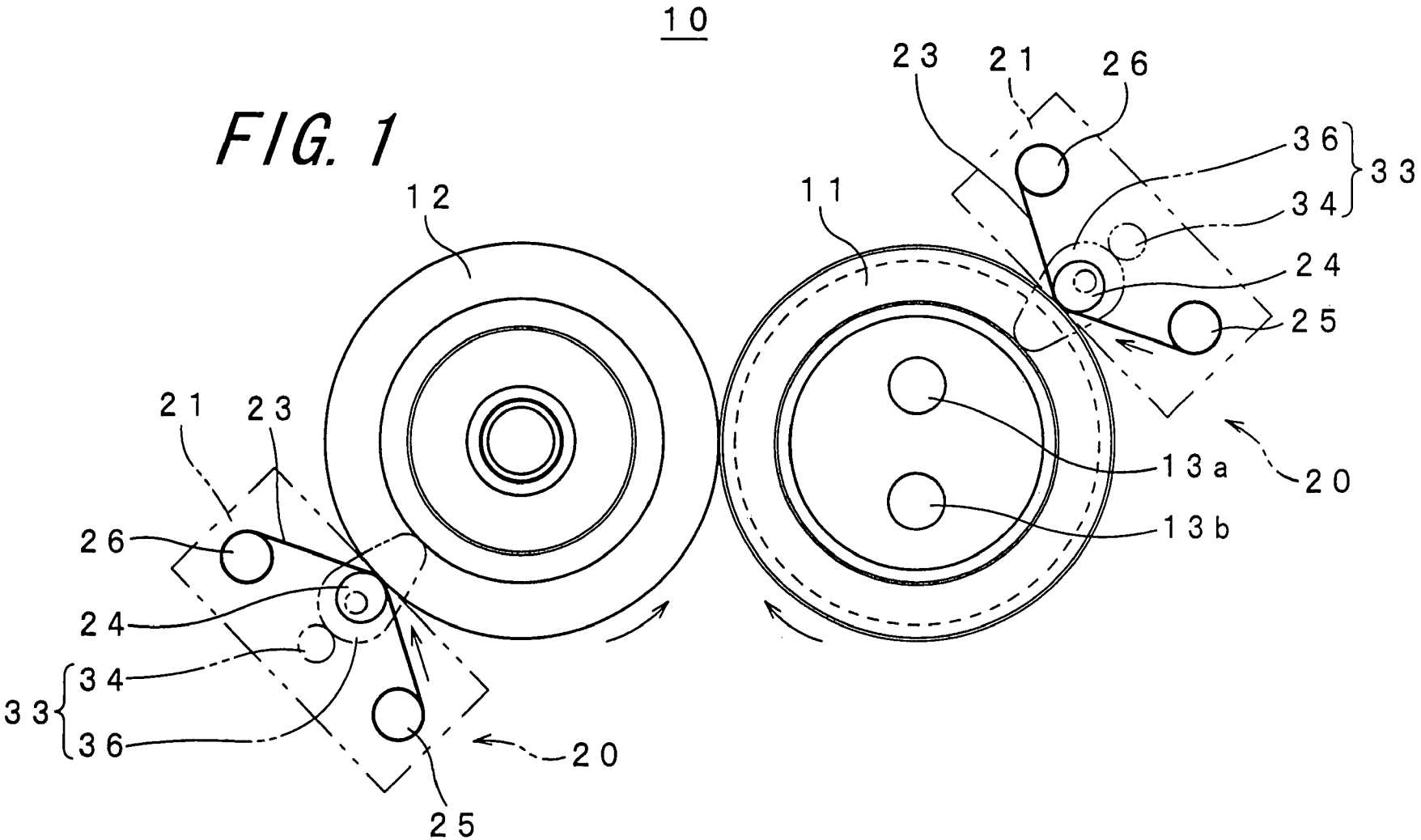
FIG. 1 is a schematic side view showing a configuration of a fixing apparatus according to a first embodiment of the invention.

Now referring to the drawings, preferred embodiments of the invention are described below.

Figure 2:
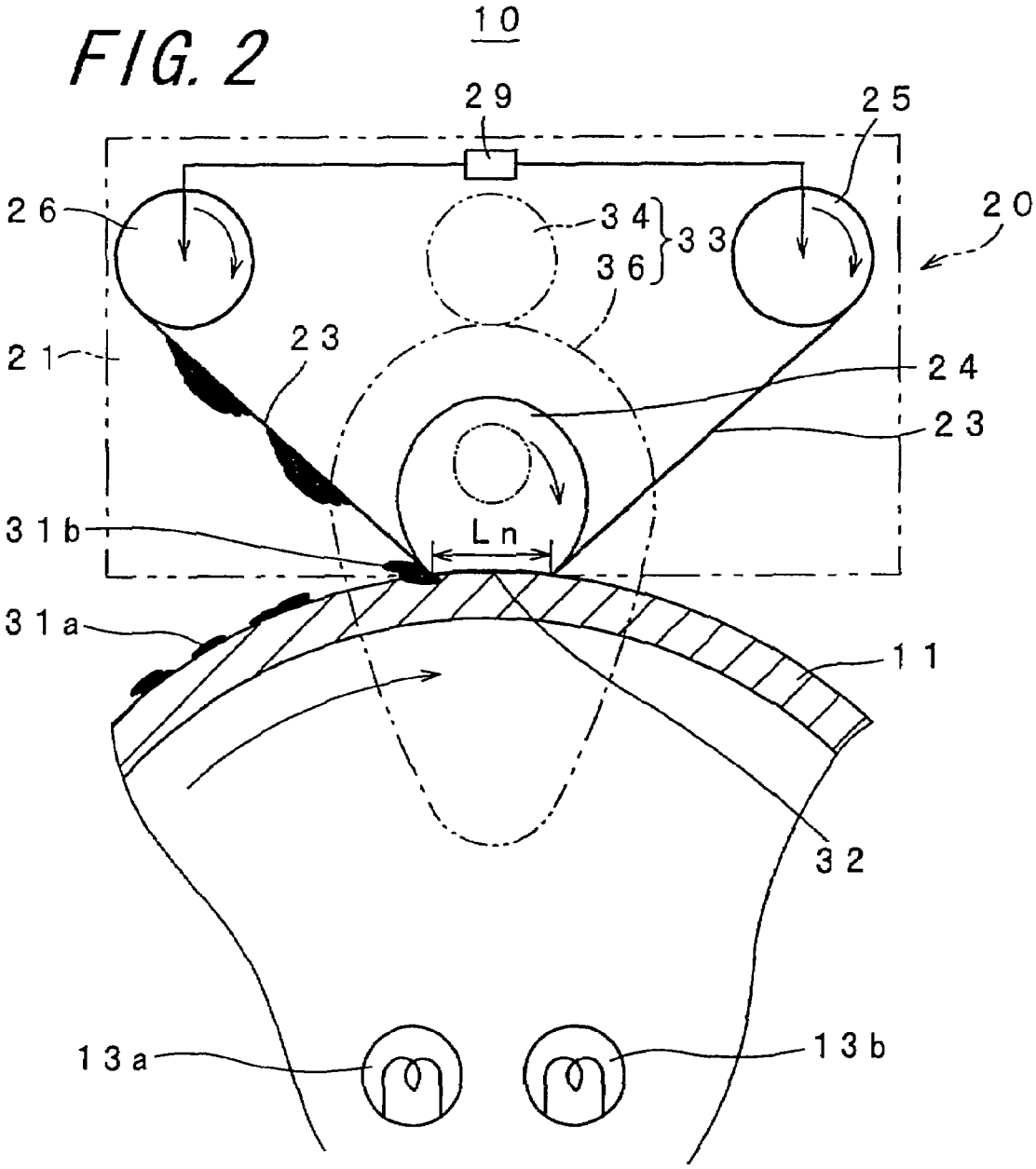
FIG. 2 is an enlarged view of the fixing apparatus shown in FIG. 1 in the vicinity of a heating roller.
Figure 3:
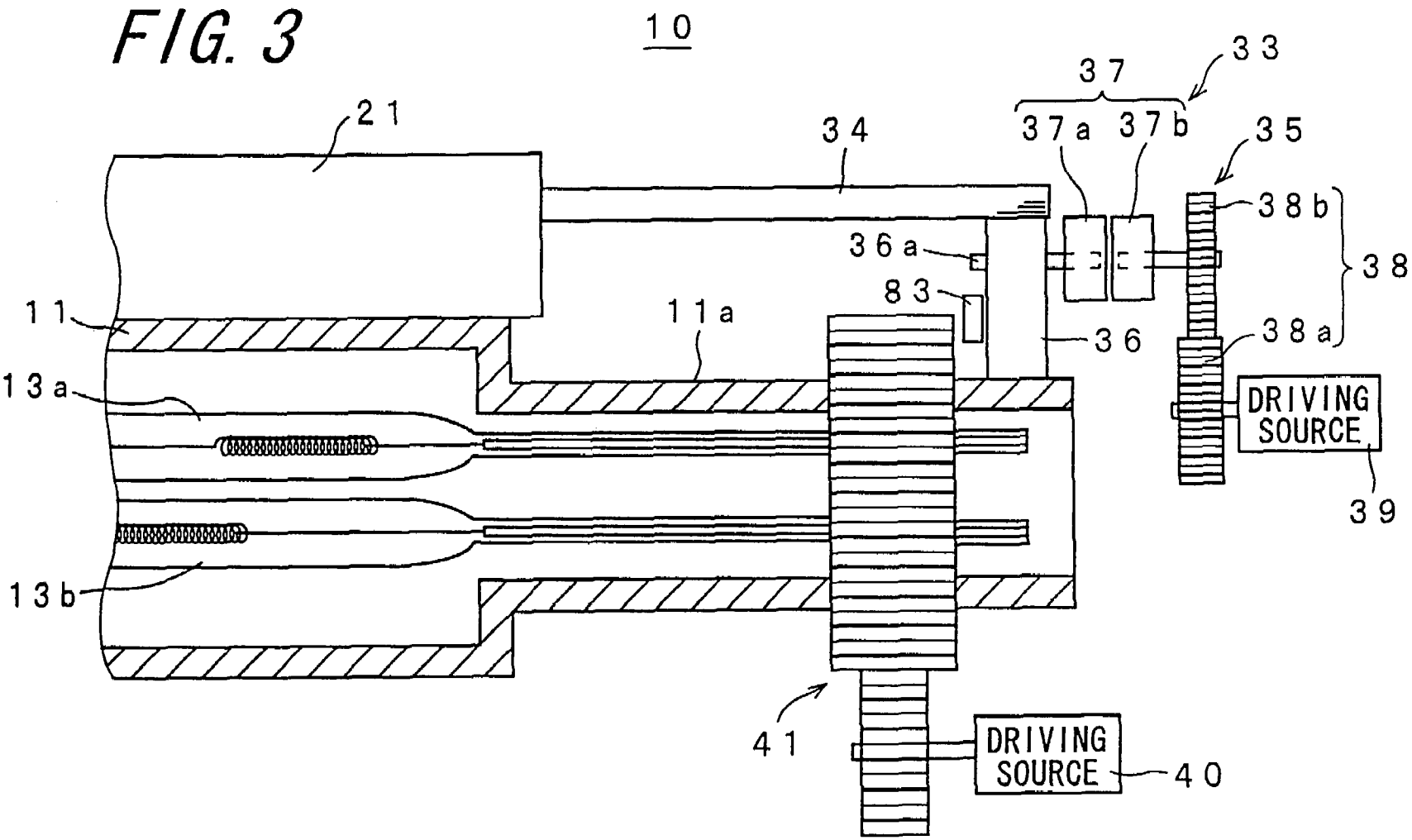
FIG. 3 is an enlarged front view of the fixing apparatus shown in FIG. 1 in the vicinity of the heating roller.

FIG. 1 is a schematic side view showing a configuration of a fixing apparatus 10 according to a first embodiment of the invention. FIG. 2 is an enlarged view of the fixing apparatus 10 shown in FIG. 1 in the vicinity of a heating roller 11. FIG. 3 is an enlarged front view of the fixing apparatus 10 shown in FIG. 1 in the vicinity of the heating roller 11.

The fixing apparatus 10 comprises the heating roller 11 and a pressure roller 12 which are formed by a pair of rotators for constituting fixing rollers; a fixing roller cleaning unit 20 serving as fixing roller cleaning means provided so as to contact respectively the heating roller 11 and the pressure roller 12, for cleaning surfaces of the fixing roller; and a propinquity/separation mechanism 33 for moving the fixing roller cleaning unit 20 close to and away from the fixing roller.

The fixing apparatus 10 is provided with various units which are similar to units provided in a heretofore known fixing apparatus. These units include, although not shown here, a heater control power source for supplying electric power to heating heaters 13*a*, 13*b* serving as heat sources provided in the heating roller 11; a temperature sensor for detecting a temperature of the heating roller 11; pressing means for pressing the pressure roller 12 on the heating roller 11; and driving means for rotationally driving the heating roller 11 and the pressure roller 12.

The fixing apparatus 10 is mounted, for instance, in an electrophotographic image forming apparatus. In this case, the fixing apparatus 10 is used for fixing that the unfixed developer is fused and fixed onto the recording medium by passing a recording medium on which an image of an unfixed developer is formed, through a nip section formed by the heating roller 11 and the pressure roller 12.

In the fixing apparatus 10 according to the embodiment, the fixing roller cleaning unit 20 are provided on both the heating roller 11 and the pressure roller 12, and formed so as to be identical each other. Accordingly, the fixing roller cleaning unit 20 provided on the heating roller 11-side will be described as a representative of the configuration so as to omit a description of the fixing roller cleaning unit 20 on the pressure roller 12-side.

The fixing roller cleaning unit 20 comprises a belt-shaped cleaning member 23 provided so as to contact the heating roller 11, for cleaning a surface of the heating roller 11; a pressure-contact roller 24 provided so as to press the cleaning member 23 on the heating roller 11 which is in contact with the cleaning member 23; a feeding roller 25 for feeding the belt-shaped cleaning member 23 which has been previously rolled up in a coil shape; a winding roller 26 for taking up the cleaning member 23 which has been fed from the feeding roller 25 so as to contact the heating roller 11, and then cleaned the surface of the heating roller 11; and a unit box 21 serving as a casing for housing the aforementioned members.

The unit box 21 has a schematic rectangular parallelepiped shape, and is formed by a steel plate, for instance. An opening is formed only on a side of the unit box 21, the side facing the heating roller 11. The pressure-contact roller 24, the feeding roller 25, and the winding roller 26 are rotatably supported by the unit box 21 due to bearings provided inside the unit box 21. In addition, inside the unit box 21 is provided also pressing means for resiliently pressing the pressure-contact roller 24 on the heating roller 11 via the cleaning member 23. The opening of the unit box 21 is formed on a side that the cleaning member 23 is pressed on the heating roller 11 by the pressure-contact roller 24.

Note that the driving means 29 of the feeding roller 25 and the winding roller 26 may be provided inside the unit box 21, and may also be provided outside the unit box 21 so as to be used as driving means for driving the other movable members.

The cleaning member 23 is a long belt-shaped windable and unwindable member. The cleaning member 23 has such a configuration that a developer 31*a* attached in a fused state to a surface of the heating roller 11 can be entered into an air layer and/or an air gap which are minute spaces, that is, the developer 31*a* can be impregnated (absorbed) into the cleaning member 23. A material having heat resistance in a temperature of approximately 200° C. which is a fixing temperature, is used for the cleaning member 23, and for instance, Nomex paper (trade name) is preferable.

The pressure-contact roller 24 has at least an outermost layer formed of an elastic material having heat resistance so as to be transformed to some extent upon being pressed on the heating roller 11, and so as to form a pressure contact region 32 (hereinafter, the pressure contact region is also referred to as a nip section 32) between the heating roller 11 and the pressure-contact roller 24. The pressure-contact roller 24 is provided so that an axial line thereof is made to be parallel to an axial line of the heating roller 11, and the cleaning member 23 interposed between the heating roller 11 and the pressure-contact roller 24 is pressed on the surface of the heating roller 11 by the aforementioned pressing/means (not shown).

The feeding roller 25 is a member in a reel form. Around the feeding roller 25 is rolled up the cleaning member 23 having a predetermined length. The feeding roller 25 is connected to a feeding roller driving portion serving as driving means (not shown), and due to the feeding roller driving portion, configured so as to be capable of being reversibly rotated and controlling a rotational speed thereof. The winding roller 26 is a member in a reel form of the same sort of the feeding roller 25, and takes up the cleaning member 23 which has been fed from the feeding roller 25 so as to be pressed on the heating roller 11 by the pressure-contact roller 24, and then cleaned the developer 31*a*. The winding roller 26 is also connected to a winding roller driving portion serving as driving means (not shown), and due to the winding roller driving portion, configured so as to be capable of being reversibly rotated and controlling a rotational speed thereof.

An operation of the fixing roller cleaning unit 20 will be simply described hereinafter. The fixing roller cleaning unit 20 feeds the cleaning member 23 from the feeding roller 25, and passes the cleaning member 23 through the nip section 32 formed between the pressure-contact roller 24 and the heating roller 11. And then, the fixing roller cleaning unit 20 engages a leading end of the cleaning member 23 with the winding roller 26 and takes up the cleaning member 23. When the leading end of the cleaning member 23 is taken up by the winding roller 26, tension is added to the cleaning member 23 by providing a brake function to the feeding roller 25.

In a state where the tension is added to the cleaning member 23, a take-up operation of the winding roller 26 is brought to a halt. In a state where the cleaning member 23 rests still, the heating roller 11 carries out rotary operation, with the result that the surface of the heating roller 11 and the cleaning member 23 slidingly contact each other, and then the cleaning member 23 cleans away the developer 31*a* attached to the surface of the heating roller 11. When the developer 31*a* has been cleaned away to some extent so that a developer 31*b* is accumulated between the cleaning member 23 and the surface of the heating roller 11, the winding roller 26 carries out a take-up operation for taking up the cleaning member 23. In other words, the winding roller 26 is rotationally driven at intervals. At a time of the taking-up occasion due to this intermittent rotary drive, it is preferred that a distance in circumferential direction in which the winding roller 26 rotationally moves, namely a travel distance of the cleaning member 23 is set to be equal to or longer than a circumference-wise distance Ln of the nip section 32 formed by pressing the pressure-contact roller 24 on the heating roller 11. The winding roller 26 thus takes up the cleaning member 23 at least longer than the distance Ln and by so doing, it is possible to reliably feed an unused portion of the cleaning member 23 to the nip section 32. Consequently, a cleaning performance due to the cleaning member 23 can be reliably recovered on every take-up operation.

The propinquity/separation mechanism 33 comprises a supporting member 34 for supporting the fixing roller cleaning unit 20, and a propinquity/separation driving portion 35 for moving the supporting member 34 close to and away from the heating roller 11.

The supporting member 34 is a member of metallic round bar. On both end faces in a longitudinal direction of the unit box 21 of the fixing roller cleaning unit 20 is respectively fixed one bar of the supporting member 34 so as to extend in a direction of the axial line of the heating roller 11. An end of the supporting member 34, the end being on an opposite side of an end attached to the unit box 21, is supported by a main body of the fixing apparatus due to a bearing having a long opening (not shown). Note that the bearing having the long opening is provided so that the long opening extends in a direction perpendicular to the axial line of the heating roller 11. In other words, the supporting member 34 having one end attached to the unit box 21 is movable so as to move close to and away from the heating roller 11 in a state of being supported by the bearing having the long opening.

The propinquity/separation driving portion 35 comprises an eccentric cam 36, an electromagnetic joint 37, a gear train 38, and a motor 39 for serving as a driving source connected to the gear train 38. The eccentric cam 36 is provided so that an axle thereof is parallel to the supporting member 34, and so as to rotate around the axle, in contact with the supporting member 34 and a core section 11*a* of the heating roller 11. A cam axial member 36*a* of the eccentric cam 36 is mounted in one join member 37*a* of the electromagnetic joint 37. The electromagnetic joint 37 is such a joint that intermittently transmits power by connecting and disconnecting one joint member 37*a* and the other joint member 37*b* by use of electromagnetic force.

An output of the motor 39 serving as a driving force is transmitted to the other joint member 37*b* connected to a second gear 38*b*, via a first gear 38*a* and the second gear 38*b* engaged with the first gear 38*a*, of the gear train 38 to which an output axis of the motor 39 is connected. Since one joint member 37*a* and the other joint member 37*b* are intermittently connected and disconnected by use of electromagnetic force as described above, a driving force of the motor 39 is transmitted to the eccentric cam 36 when the eccentric cam 36 and the second gear 38*b* are connected by the electromagnetic joint 37 whereas the eccentric cam 36 is brought to a halt when the eccentric cam 36 and the second gear 38*b* are disconnected by the electromagnetic joint 37.

The eccentric cam 36 is thus rotated around the axle thereof and brought to an halt at a desired position. By so doing, the supporting member 34 and the unit box 21 having the supporting member 34 attached thereto, namely the fixing roller cleaning unit 20, can be made to move close to and away from the heating roller 11.

On the eccentric cam 36 is mounted an eccentric cam position sensor 83 for detecting a rotary position of the eccentric cam 36. For the eccentric cam position sensor 83, for instance, a mechanical sensor is used. The eccentric cam position sensor 83 is set so as to output an ON signal when the rotary position of the eccentric cam 36 is at a position where the fixing roller cleaning unit 20 is made to contact the fixing roller, and so as to be OFF when the rotary position of the eccentric cam 36 is at a position where the fixing roller cleaning unit 20 is made to move away from the fixing roller. By mounting such an eccentric cam position sensor 83, it is possible to detect whether the fixing roller cleaning unit 20 is in contact with or apart from the fixing roller.

Note that in FIG. 1 and FIG. 2 are omitted illustrations of the propinquity/separation driving portion 35 except for the eccentric cam 36 in order to avoid intricacy. Moreover, in FIG. 3 are shown a motor 40 serving as a driving source for driving the heating roller 11, and a gear train 41 including a gear connected to the motor, and a gear which is engaged with the gear and mounted in the core section 11*a* of the heating roller 11.

In a fixing apparatus 10 according to the embodiment, the propinquity/separation mechanism 33 moves the fixing roller cleaning unit 20 close to and away from the fixing roller in accordance with a detected output of a temperature sensor for detecting a temperature of the fixing roller. Such a propinquity/separation operation can be realized as follows. A chip is provided in the fixing apparatus 10, and a boundary temperature is predetermined and stored in a memory of the chip. The detected output due to the temperature detector is inputted to the chip and then, a detected temperature and the boundary temperature are compared to each other. When the detected temperature is equal to or higher than the boundary temperature, an operation command is outputted from the chip to the propinquity/separation driving portion 35 of the propinquity/separation mechanism 33, with the result that the propinquity/separation operation can be realized. Note that, in a case where the fixing apparatus 10 is mounted in an image forming apparatus, the detected output of the temperature sensor may be also made to be inputted to a control portion of the image forming apparatus so that the operation command may be outputted from the control portion to the propinquity/separation driving portion 35.

A temperature selected as a predetermined boundary temperature is a softening temperature, preferably a predetermined fixing temperature. When the detected temperature becomes equal to or higher than this boundary temperature, the propinquity/separation mechanism 33 makes the fixing roller cleaning unit 20 contact the fixing roller. The fixing roller cleaning unit 20 is thus made to contact the fixing roller only when the temperature of the fixing roller is at least equal to or higher than the softening temperature of the developer. By so doing, the fixing roller is made not to be scrubbed by a hard solidified developer and therefore, the fixing roller can be prevented from being damaged.

Figure 4:
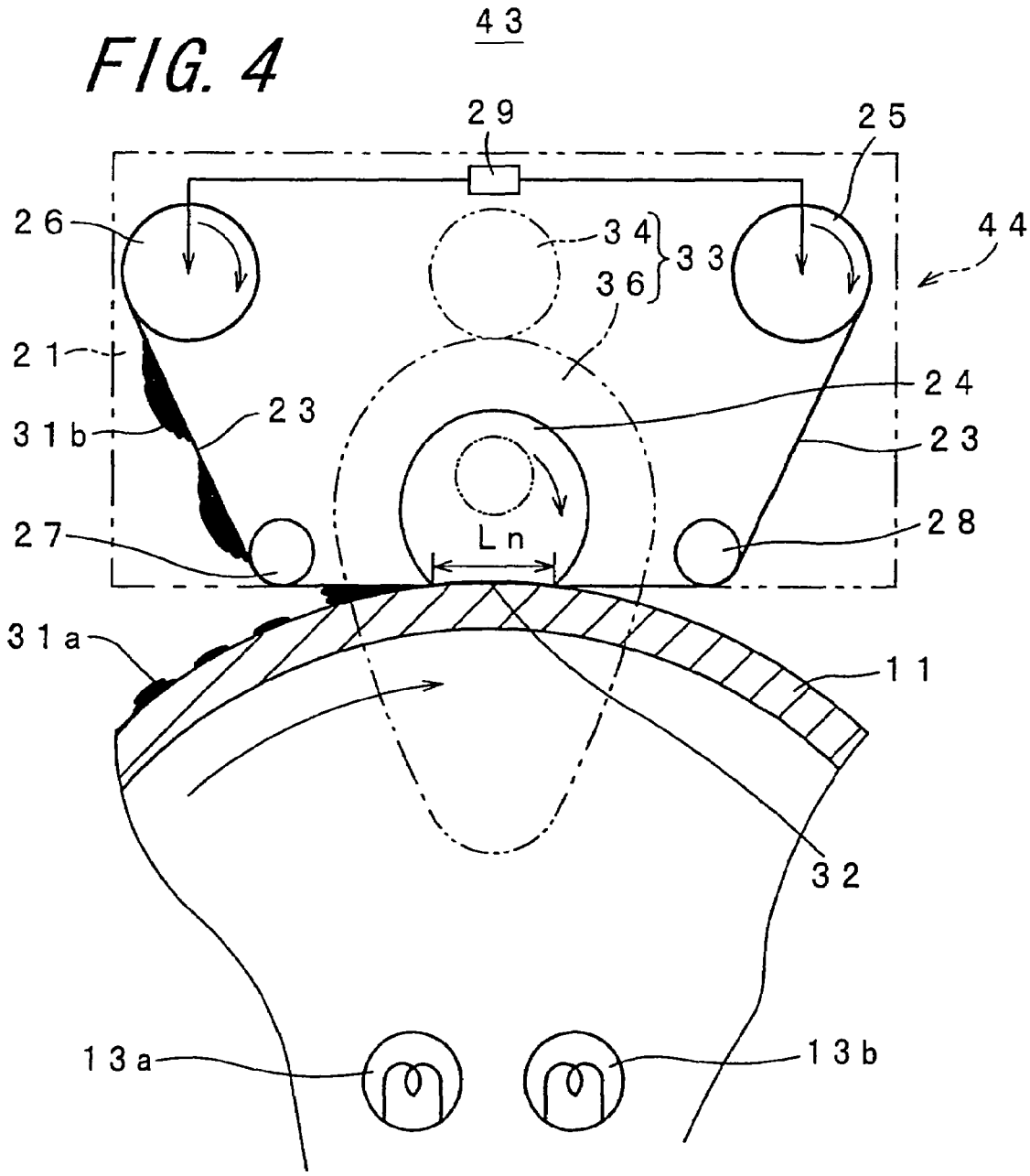
FIG. 4 is a schematic view showing a configuration of a fixing apparatus according to a second embodiment of the invention.

FIG. 4 is a schematic view showing a configuration of a fixing apparatus 43 according to a second embodiment of the invention. The fixing apparatus 43 according to the embodiment is similar to the fixing apparatus 10 according to the first embodiment, so that a corresponding component will be denoted by the same reference numeral and a description thereof will be omitted. Moreover, in FIG. 4 is only shown an enlarged view of the fixing apparatus 43 in the vicinity of the heating roller 11, but a configuration in the vicinity of the pressure roller 12 is also identical with the vicinity of the heating roller 11.

The fixing apparatus 43 has a feature in a fixing roller cleaning unit 44 serving as a fixing roller cleaning means. The fixing roller cleaning unit 44 includes, in addition to the fixing roller cleaning unit 20 shown in the first embodiment, a first guide roller 27 provided between the pressure-contact roller 24 and the winding roller 26 so as to contact the cleaning member 23, and a second guide roller 28 provided between the feeding roller 25 and the pressure-contact roller 24 so as to contact the cleaning member 23.

It is preferred that the first and second guide rollers 27, 28 are rollers made of metal having excellent heat conductance such as iron alloy, aluminum, aluminum base alloy, copper, and copper base alloy. This is because the developer 31*b* in a fused or softened state attached to the cleaning member 23 can be easily solidified, when the cleaning member 23 that has cleaned the surface of the heating roller 11 passes as being in contact with the guide rollers, by making a heat transfer loss to the guide rollers since the first and second guide rollers 27, 28 are made of metal having excellent heat conductance.

The first and second guide rollers 27, 28 are disposed at such a position that the cleaning member 23 stretched between the pressure-contact roller 24 and the winding roller 26 and also between the pressure-contact roller 24 and the feeding roller 25 can be further stretched out. Preferably, the first and second guide rollers 27, 28 are disposed at such a position that, in a cross section perpendicular to the axial line of the heating roller 11, a straight line formed by the cleaning member 23 stretched between the first guide roller 27 and the second guide roller 28 extends in a tangential direction with respect to an outer circumferential surface of the heating roller 11.

By thus disposing the first and second guide rollers 27, 28 so that the cleaning member 23 extends in the tangential direction of the heating roller 11, tension added to the cleaning member 23 has an enhanced stability, with the result that it is possible to effectively suppress vibration of the cleaning member 23 during the take-up operation.

By thus disposing the first and second guide rollers 27, 28, even at a time of starting the take-up operation by the winding roller 26, the cleaning member 23 is made not to be attached to the pressure-contact roller 24, with the result that there occurs no pulsation or the like caused by a rebound attributable to detachment of the cleaning member 23 from the pressure-contact roller 24 and therefore, the take-up operation can be smoothly carried out. Accordingly, the developer 31*b* removed by the cleaning member 23 is prevented from being detached from the cleaning member 23 and attached again to the fixing roller at a time of starting the take-up operation so that an excellent cleaning performance is obtained.

Figure 5:
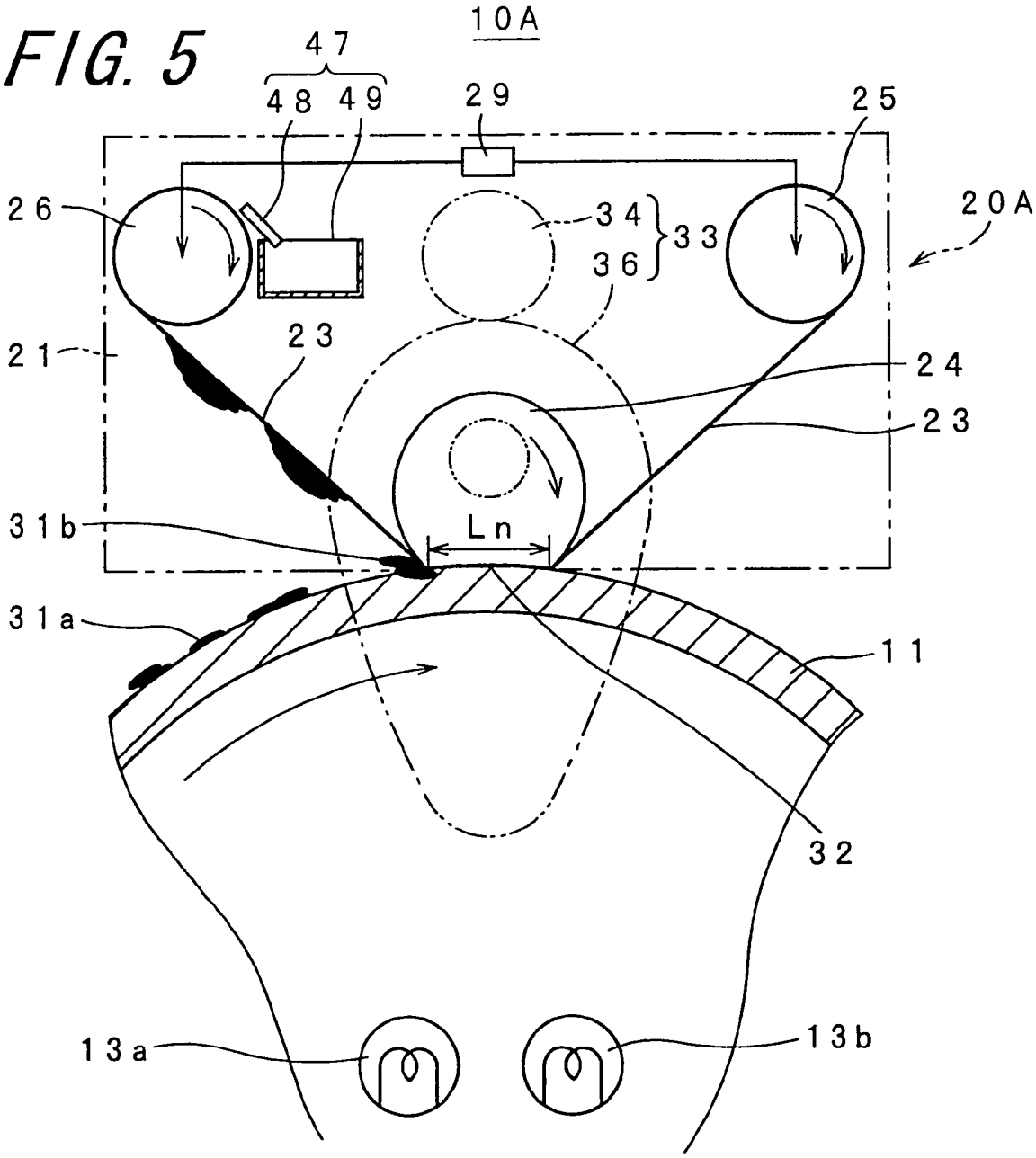
FIG. 5 is a schematic view showing a configuration of a fixing apparatus according to a third embodiment of the invention.
Figure 6:
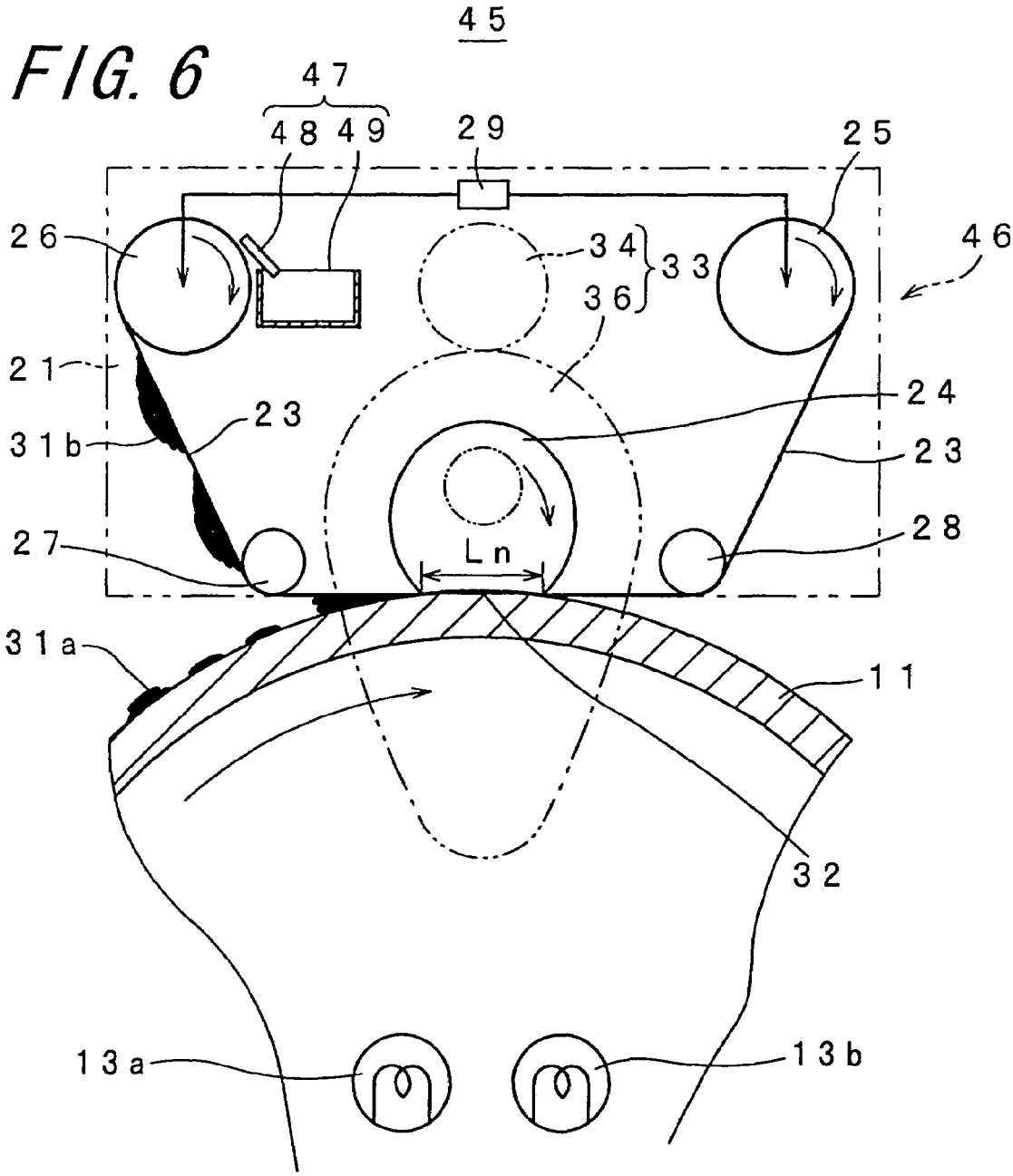
FIG. 6 is a schematic view showing a configuration of a fixing apparatus according to a fourth embodiment of the invention.

FIG. 5 is a schematic view showing a configuration of a fixing apparatus 10A according to a third embodiment of the invention. FIG. 6 is a schematic view showing a configuration of a fixing apparatus 45 according to a fourth embodiment of the invention. The fixing apparatus 10A according to the third embodiment of the invention is similar to the fixing apparatus 10 according to the first embodiment, so that a corresponding component will be denoted by the same reference numeral and a description thereof will be omitted. The fixing apparatus 45 according to the fourth embodiment of the invention is similar to the fixing apparatus 43 according to the second embodiment, so that a corresponding component will be denoted by the same reference numeral and a description thereof will be omitted. Moreover, in FIGS. 5 and 6 are only shown enlarged views of the fixing apparatuses 10A and 45 in the vicinity of the heating roller 11, but a configuration in the vicinity of the pressure roller 12 is also identical with the vicinity of the heating roller 11.

The fixing apparatuses 10A and 45 have a feature in fixing roller cleaning units 20A and 46 serving as fixing roller cleaning means. The fixing roller cleaning units 20A and 46 are characterized by further comprising developer removing means 47 for removing a developer existent on the surface of the to-be-taken-up cleaning member 23 provided on a periphery of the winding roller 26.

The developer removing means 47 comprises a blade member 48 provided so that an end thereof contacts the cleaning member 23 to be taken up by the winding roller 26, and a collection container 49 for collecting the developer removed from the surface of the cleaning member 23 by the blade member 48.

The blade member 48 is a platy member formed of metal, resin, or the like having elasticity, and extends in a direction of an axial line of the winding roller 26. One end of the blade member 48 in a direction perpendicular to the axial line contacts the cleaning member 23 to be taken up by the winding roller 26, and the other end thereof is mounted in a main body of the fixing apparatuses 10A and 45. The collection container 49 is a hollow container having a schematic rectangular parallelepiped shape, in which an opening is formed over all sides. The collection container 49 is mounted in the main body of the fixing apparatuses 10A and 45 in such a configuration that the developer removed from the surface of the cleaning member 23 by the blade member 48 is collected through the opening.

Particularly, according to the fixing apparatus 45 of the fourth embodiment of the invention, the developer 31*b* in a fused state, removed from the surface of the heating roller 11 (as well as the pressure roller 12) by the cleaning member 23 is easily solidified by the heat transfer loss to the first guide roller 27 since the cleaning member 23 is taken up in slidingly contact with the first guide roller 27 at a time of being taken up by the winding roller 26. In such a manner, the developer removing means 47 cleans the developer 31*b* in a solidified state away from the cleaning member 23 and therefore, the developer in the solidified state can be removed with extreme ease, and such a clean state that the cleaning member 23 is reusable can be made.

Consequently, the winding roller 26 can form a taken-up shape of the to-be-taken-up cleaning member 23 into a precise cylindrical shape. In other words, an installation of the developer removing means 47 can solve such a problem that the taken-up shape of the cleaning member 23 becomes irregular and a taken-up diameter varies depending on an attached amount of the developer 31*b*, caused by winding the developer 31*b* into the winding roller 26 when the cleaning member 23 is taken up without having the developer 31*b* removed from the surface thereof.

Furthermore, by taking up the finely cleaned cleaning member 23, it is made possible to easily obtain the taken-up diameter based on a take-up speed and a thickness of the cleaning member 23, with result that a rotational speed control of the winding roller 26 and the feeding roller 25 can be made easy.

For instance, it is assumed that the feeding roller 25 and the winding roller 26 have the same diameter, and a ratio of a diameter on the feeding roller 25-side on which the cleaning member 23 has been previously rolled up, to a diameter of the winding roller 26 is 2:1 in an initial state of the fixing roller cleaning units 20A and 46. In this regard, a ratio of the diameter of the feeding roller 25 to a diameter on the winding roller 26-side which has taken up the cleaning member 23 becomes 1:2 in a state where all the cleaning member 23 has been used and taken up by the winding roller 26. Accordingly, it is made possible to correctly calculate a ratio of the diameter on the winding roller 26-side to the diameter on the feeding roller 25-side in mid-course of the operation so that the rotational speed control can be made easy as described above.

In addition, the winding roller 26 and the feeding roller 25 are configured so as to be capable of being reversibly rotated and therefore, it is possible to reuse the cleaning member 23 which has been cleaned and taken up. Note that developer removing means may be provided also on the feeding roller 25-side acting as a winding roller upon a reuse of the cleaning member 23, although illustrations of the developer removing means are omitted in FIGS. 5 and 6. In this regard, the cleaning member 23 upon the reuse is also cleaned and taken up, with the result that the cleaning member 23 can be repeatedly used. Consequently, an exchange frequency of the cleaning member 23 can be reduced so as to decrease an intricacy of the operation, and a running cost can be reduced.

Figure 7:
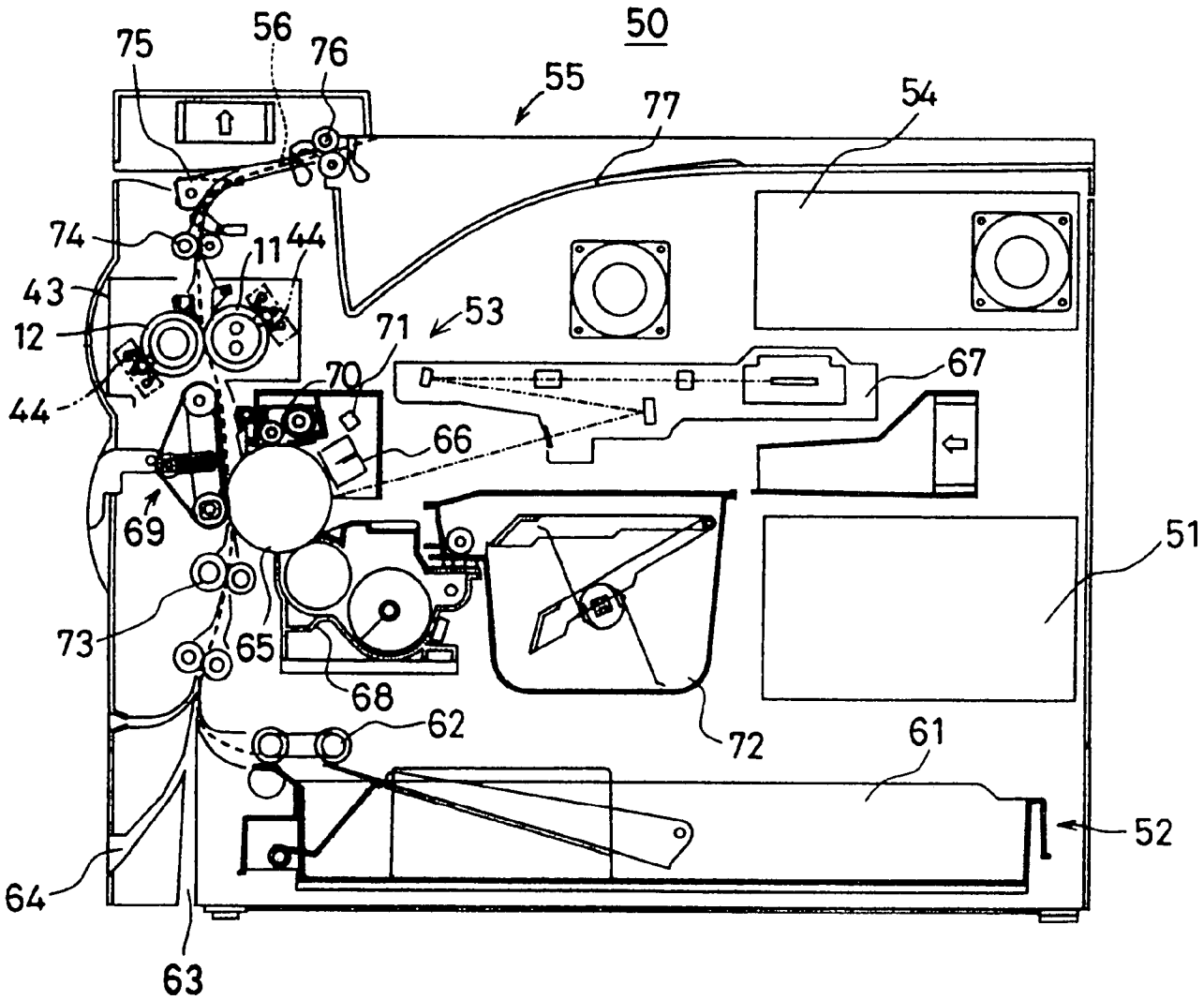
FIG. 7 is a schematic view showing a configuration of an image forming apparatus according to a fifth embodiment of the invention.

FIG. 7 is a schematic view showing a configuration of an image forming apparatus 50 according to a fifth embodiment of the invention. In the image forming apparatus 50 is provided the above-described fixing apparatus 43 according to the second embodiment. The image forming apparatus 50 illustrated in the embodiment is an electrophotographic printer.

The image forming apparatus 50 largely comprises a power source unit 51 for supplying electric power to various units of the image forming apparatus 50; a sheet supply unit 52 for supplying a recording paper serving as a recording medium on which an image is formed and recorded; a image forming unit 53; the fixing apparatus 43; a control portion 54 for receiving image information from an external equipment and controlling a whole operation of the image forming apparatus 50; a discharge unit 55; and a sheet conveying system 56 for controlling conveyance of a recording paper from the sheet supply unit 52 to the discharge unit 55.

The sheet supply unit 52 is provided with a supply tray 61 for housing a recording paper, and a pickup roller 62 for feeding the recording paper housed in the supply tray 61 sheet by sheet to the sheet conveying system 56. Note that under the sheet supply unit 52 and under a main body of the image forming apparatus, a sheet supply unit including a multistage sheet tray, a high-capacity sheet supply unit capable of housing sheets in large quantity, or the like may be disposed as a peripheral equipment. In a case where such a peripheral equipment is provided, the recording paper from the peripheral equipment is supplied from a sheet receiving unit 63 and an expansive sheet receiving unit 64 to the main body of the image forming apparatus.

The image forming unit 53 is disposed above the sheet supply unit 52. The image forming unit 53 comprises a photoreceptor 65, and a charging unit 66, a light scanning unit 67, a developing unit 68, a transfer unit 69, a cleaning unit 70 and an electricity removing lamp 71, which are disposed along an outer circumferential surface of the photoreceptor 65.

The charging unit 66 uniformly charges a surface of the photoreceptor 65 which has not yet been exposed to light by the light scanning unit 67. The light scanning unit 67 scans the uniformly charged photoreceptor 65 with a light in accordance with the image information so as to form an electrostatic latent image. The developing unit 68 supplies the developer inside a developer supply container 72 to the electrostatic latent image formed on the surface of the photoreceptor 65 so as to form a visualized developer image.

The transfer unit 69 transfers the developer image on the recording paper which is supplied in arranged timing so that a registration roller 73 provided upstream of the photoreceptor 65 in the sheet conveying system 56 registers the recording paper at a developer image forming position on the photoreceptor 65.

The cleaning unit 70 removes a residual developer which has not been transferred on the recording paper and remains on the photoreceptor 65. The electricity removing lamp 71 removes charges on the surface of the photoreceptor 65, thereby preparing for next uniform charging of the charging unit 66.

The fixing apparatus 43 is provided downstream of the transfer unit 69 in the sheet conveying system 56 so that the developer image transferred on the recording paper is fixed so as to form a solid recording image.

A conveyance roller 74 and a switching gate 75 are disposed further downstream of the fixing apparatus 43 in the sheet conveying system 56. The conveyance roller 74 conveys the recording paper which has passed through the fixing apparatus 43, to further downstream in the sheet conveying system 56. The switching gate 75 optionally opens a conveyance path which is suitable for the recording paper to be conveyed by the conveyance roller 74, to be conveyed. The discharge unit 55 comprises a discharge roller 76 provided further downstream of the switching gate 75 in the sheet conveying system 56, and a discharge tray 77 for placing the recording paper discharged outward the main body of the image forming apparatus by the discharge roller 76.

The control portion 54 is a process circuit hating a central processing unit (CPU), for instance. The control portion 54 has accessories such as a memory serving as storing means and an interface for receiving image information from an external equipment. The control portion 54 controls a whole operation of the image forming apparatus 50, and to-be-controlled objects thereof include the fixing apparatus 43. The memory of the control portion 54 previously stores a program and an operational control condition for controlling the whole operation of the image forming apparatus 50.

An image forming operation in the image forming apparatus 50 will be described hereinafter. For instance, image information produced by external equipments such as a personal computer is given to the control portion 54 via the interface and then, the image information is stored in the memory of the control portion 54. The control portion 54 reads out the image information from the memory and performs image processing such as conversion process. And then, the control portion 54 feeds the image information to the light scanning unit 67. The light scanning unit 67 irradiates the surface of the photoreceptor 65, which has been charged by the charging unit 66 so as to have a uniform electric potential, with light in accordance with the image information so as to form an electrostatic latent image.

The electrostatic latent image formed on the surface of the photoreceptor 65 is developed by the developing unit 68 so as to be a developer image. The transfer unit 69 transfers the developer image formed on the photoreceptor 65 onto the recording paper which has been supplied from the sheet supply unit 52 and fed in arranged timing by the registration roller 73. The recording paper on which the developer image has been transferred, is fixed by the fixing apparatus 43 and then discharged to the discharge tray 77 by the discharge roller 76.

On the other hand, the photoreceptor 65 from which the developer image is detached by the transfer unit 69, has the residual developer cleaned by the cleaning unit 70 and the electricity removed by the electricity removing lamp 71. The image forming apparatus 50 can repeat the aforementioned image forming operation.

The fixing apparatus 43 mounted on the image forming apparatus 50 operates so that the developer on the recording paper is made to be fused and softened so as to be fixed on the recording paper. However, the developer is attached to the fixing roller by repeating a fixing operation on a plurality of the recording papers and therefore, the fixing roller is cleaned by the cleaning member 23 of the fixing roller cleaning unit 44 as described above. Furthermore, attributable to the cleaning, in a gap between the cleaning member 23 and the fixing roller is accumulated to some extent the developer removed from the fixing roller and then, the winding roller 26 is made to be rotationally driven so as to take up the cleaning member 23 by a certain length so that a clean portion of the cleaning member 23 is newly made to slidingly contact the fixing roller. By so doing, the cleaning member 23 is made to recover a cleaning capability thereof so as to continue to clean the fixing roller.

Figure 8:
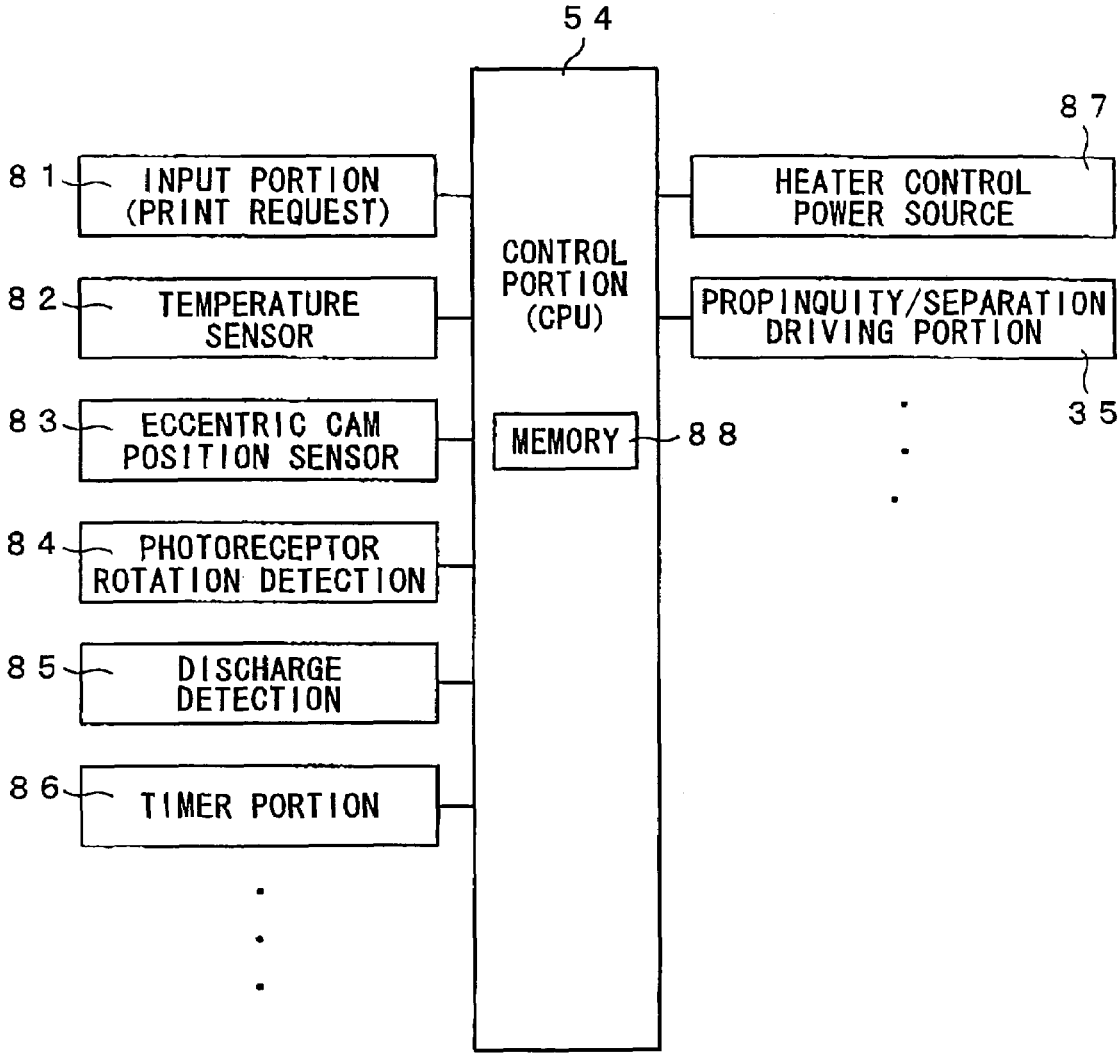
FIG. 8 is a block diagram showing an electrical structure according to an operation of a propinquity/separation mechanism of a fixing apparatus in an image forming apparatus.

FIG. 8 is a block diagram showing an electrical structure according to an operation of the propinquity/separation mechanism 33 of the fixing apparatus 43 in the image forming apparatus 50.

In the image forming apparatus 50, to an input side of the control portion 54 having a memory 88 are connected an input portion 81 for a print request; a temperature sensor 82 for detecting a temperature of the fixing roller; a eccentric cam position sensor 83 for detecting rotary position of the eccentric cam 36 of the propinquity/separation mechanism 33; photoreceptor rotation detecting means 84 for detecting whether the photoreceptor 65 rotates or not; discharge detecting means 85 for detecting a discharging operation in the discharge unit 55; and a timer portion 86 serving as time counting means. To an output side of the control portion 54 are connected a heater control power source 87 for supplying electric power to the heating heater 13 of the heating roller 11, and the propinquity/separation driving portion 35 of the propinquity/separation mechanism 33. Note that to the control portion 54 are connected various input systems and output systems other than various units shown in FIG. 8 for operating the image forming apparatus 50, but these systems are omitted in order to avoid intricacy of the drawing.

The image forming apparatus 50 has the electrical structure shown in FIG. 8, with the result that it is made possible to not only move the fixing roller cleaning unit 44 of the fixing apparatus 43 close to and away from the fixing roller based only on the boundary temperature as described above, but also perform a close-to/away-from operation as follows.

The image forming apparatus 50 detects a halt of rotation of the photoreceptor 65 by the photoreceptor rotation detecting means 84 and counts a length of time that has elapsed since a halt of rotation of the photoreceptor by the timer portion 86. When the counted time becomes a predetermined value, an operation command is outputted to the propinquity/separation driving portion 35 by the control portion 54, with the result that the fixing roller cleaning unit 44 can be moved away from the fixing roller.

Figure 9:
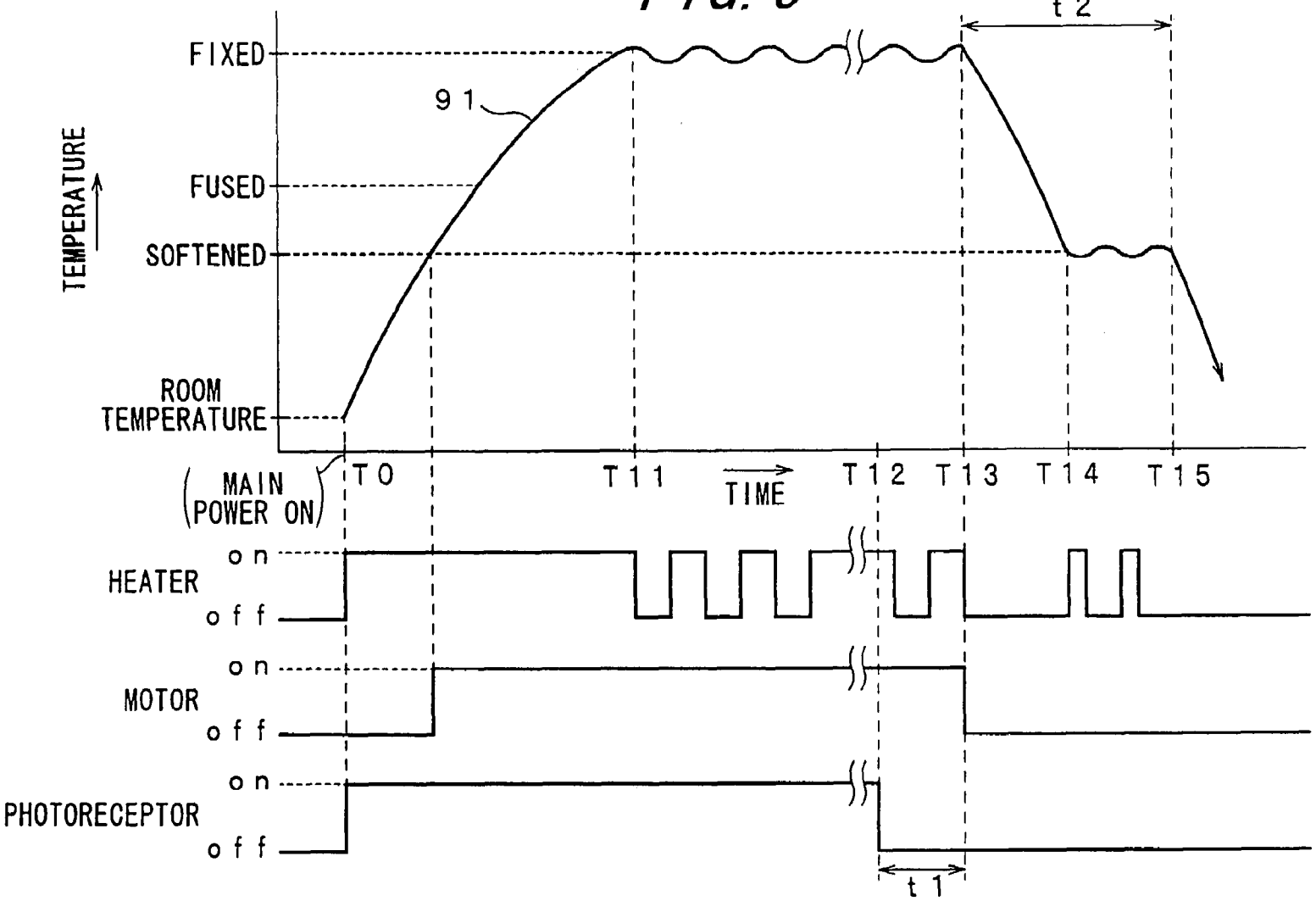
FIG. 9 is a time chart showing a relation between a temperature transition of a fixing roller and a rotary operation of a photoreceptor.
Figure 12:
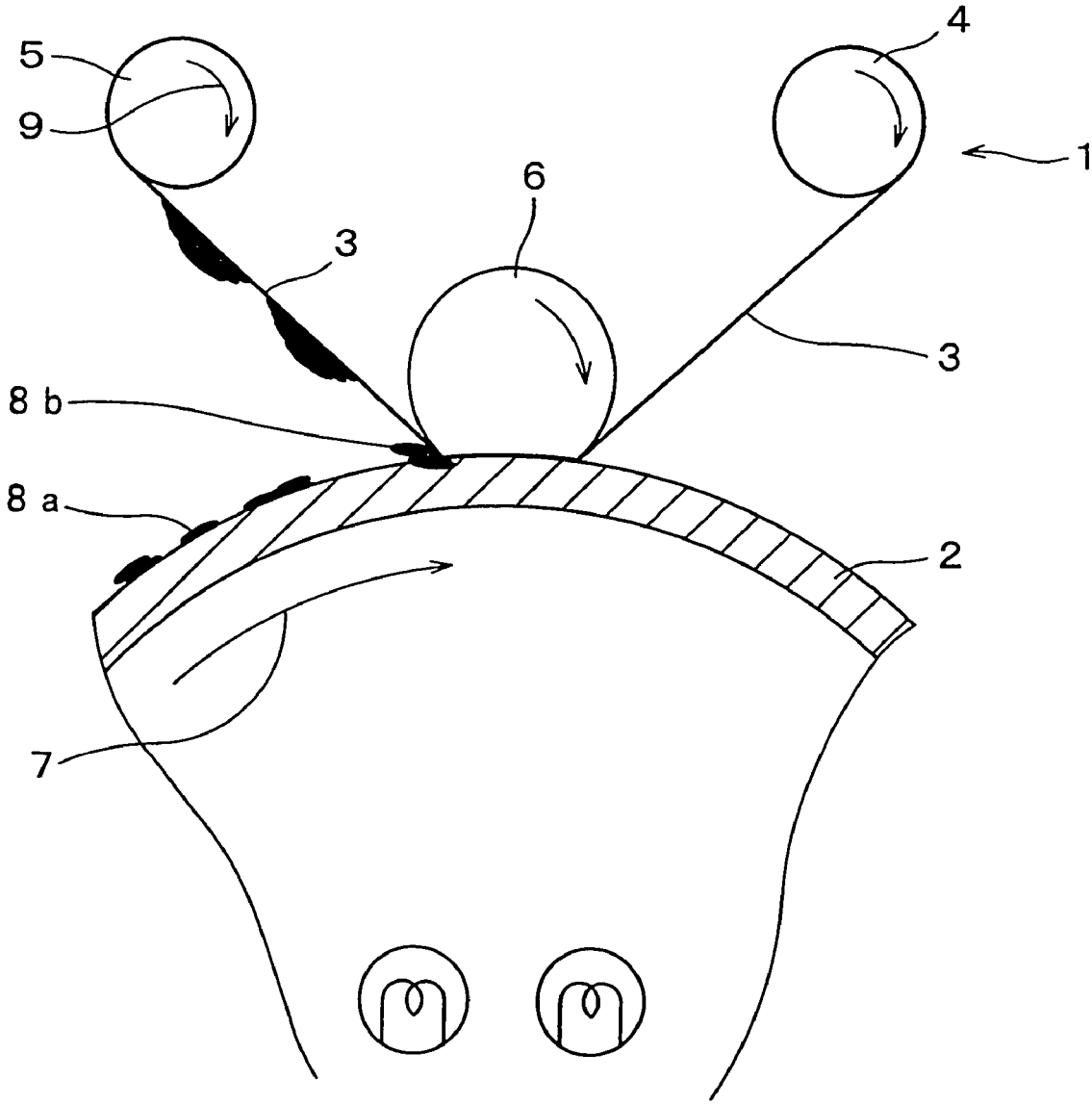
FIG. 12 PRIOR ART
FIG. 12 is a schematic view showing a configuration of fixing roller cleaning means provided in a fixing apparatus of related art.

FIG. 9 is a time chart showing a relation between a temperature transition of the fixing roller and the rotary operation of the photoreceptor 65. With reference to the timing chart in FIG. 9, the rotary operation of the photoreceptor 65, the temperature of the fixing roller, and an operation of the propinquity/separation mechanism 33 will be described hereinafter.

A line 91 in FIG. 9 indicates an example of a detected result of the temperature of the fixing roller due to the temperature sensor 82. In the detected result, the time is taken along a horizontal axis and the temperature is taken along a vertical axis. When a main power of the apparatus is turned on at a time of T0, the temperature of the fixing roller is a room temperature. At the same time as bringing the main power to ON, the heater control power source 87 for supplying electricity to the heating heater 13 serving as a heat source of the heating roller 11 is turned on as a part of an apparatus initializing operation so that the temperature of the fixing roller starts to rise. In addition, the photoreceptor 65 also starts the rotary operation at this time.

When the temperature of the fixing roller rises up to the softening temperature of the developer, a motor serving as a roller driving portion for driving the fixing roller is tuned on so that the fixing roller starts to rotate. Furthermore, at a time of T11 that the temperature of the fixing roller continues to rise up to the predetermined fixing temperature which is equal to or higher than the fusing temperature of the developer, in response to the detected output of the temperature sensor 82, the control portion 54 controls ON/OFF of the heater control power source 87 so that the temperature of the fixing roller maintains substantially constant at the predetermined fixing temperature.

After the time of T11 is executed such an image forming operation that the image formed by the image forming unit 53 is fixed by the fixing apparatus 43 so as to be discharged.

When the image forming operation in the image forming unit 53 ends, the photoreceptor 65 stops rotating at a time of T12. This halt of rotation is detected by the photoreceptor rotation detecting means 84 so as to be inputted to the control portion 54. The end of the image forming operation in the image forming unit 53 can be detected by comparing, for instance, the number of image formed sheets, designated by the print request serving as an image forming command signal, and a counted value that the number of sheets passed through the image forming unit 53 is counted. The control portion 54 outputs a rotation halt signal to the photoreceptor 65 based on the detected result, and the photoreceptor rotation detecting means 84 detects that the photoreceptor 65 has actually stopped rotating.

Since the recording paper on which the image is formed by the image forming unit 53, is conveyed to the fixing apparatus 43 so as to be fixed, in the fixing apparatus 43, the motor serving as the driving portion of the fixing roller continues the rotary operation for a while and moreover, the ON/OFF control of the heating heater 13, that is, the heater control power source 87 is continued so that the fixing operation can be carried out even after the photoreceptor 65 stops rotating at the time of T12. When a length of time required for the last recording paper on which the image is formed, to be fixed after being conveyed form the image forming unit 53 to the fixing apparatus 43, namely a length of time of t1 between the time of T12 and a time of T13, has elapsed, the control portion 54 turns off the heater control power source 87 and further halts the rotation of the fixing roller so that the energy-saving mode is brought.

A time of t1 between the halt of rotation of the photoreceptor 65 and a launch of the energy-saving mode is previously determined as a design specification that reflects a capability of the image forming apparatus 50, and stored in the memory 88.

The control portion 54 obtains the length of time that has elapsed since the halt of rotation of the photoreceptor 65 based on the detected result of the halt of rotation of the photoreceptor 65 due to the photoreceptor rotation detecting means 84, and the counting time from the timer portion 86. And then, the control portion 54 compares the elapsed time and a preset time t1 previously stored in the memory 88. When the elapsed time reaches a base time t1, the apparatus is brought to the energy-saving mode, and the operation command is outputted to the propinquity/separation driving portion 35 so as to move the propinquity/separation mechanism 33 so that the fixing roller cleaning unit 44 is made to move away from the fixing roller.

This method that the operation of the propinquity/separation mechanism 33 is controlled based on the length of time that has elapsed since the halt of the rotary operation of the photoreceptor 65, can allow various variations thereof.

For instance, although the temperature of the fixing roller declines after the apparatus is brought to the energy-saving mode, the energy-saving mode is such a standby state that the image formation can be resumed shortly after receiving an image forming command, if any, and the temperature of the fixing roller is not lowered to the room temperature, but maintained at the softening temperature of the developer. Accordingly, at a time when the temperature of the fixing roller reaches the softening temperature of the developer, the fixing roller cleaning unit 44 can be also moved away from the fixing roller.

In FIG. 9, after the energy-saving mode is brought at the time of T13, the temperature of the fixing roller declines down to the softening temperature at a time of T14 and therefore, the fixing roller cleaning unit 44 is made to move away from the fixing roller at this time of T14. This is an operational control method of the aforementioned propinquity/separation mechanism 33. Note that ON/OFF of the heater control power source 87 is controlled at the energy-saving mode in order to maintain the temperature of the fixing roller at the softening temperature.

Further, when the image forming command is not given so that the image forming operation is not executed until another preset base time t2 is elapsed after the apparatus is brought to the energy-saving mode, there may be applied a method that the control portion 54 controls the operation of the power source unit 51 so as to make the shut off mode that only standby electricity is transmitted to the apparatus, and controls the operation of the propinquity/separation mechanism 33 so as to move the fixing roller cleaning unit 44 away from the fixing roller. The base time t2 until a launch of the shut off mode after this energy-saving mode is brought, that is an elapsed time between the time of T13 and a time of T15 in FIG. 9, is preset and stored in the memory 88.

FIG. 10 is a flow chart for explaining an operational control over the propinquity/separation mechanism 33 due to the control portion 54 based on a length of time that has elapsed since a halt of rotation of the photoreceptor 65. With reference to FIG. 10, there will be described, among the above-described variations of the control method, a method of moving the fixing roller cleaning unit 44 away from the fixing roller at a time when the temperature of the fixing roller reaches the softening temperature of the developer.

A start of a step s0 is a state where, for instance, image information previously created by a personal computer or the like is given to the image forming apparatus 50, and stored in the memory 88 of the control portion 54 in the image forming apparatus, and then the print request is inputted to the image forming apparatus 50, with the result that image read out from the memory 88 can be printed and fixed.

At step s1, the main power of the image forming apparatus 50 is turned on by an operator. At step s2, the control portion 54 determines on the basis of the detected output of the eccentric cam position sensor 83 whether the fixing roller cleaning unit 44 is away from the fixing roller or not. The operation proceeds to step s4 when the fixing roller cleaning unit 44 is away from the fixing roller whereas the operation proceeds to step s3 when the fixing roller cleaning unit 44 is not away from the fixing roller. At step s3, the control portion 54 outputs an operational command to the propinquity/separation driving portion 35 to operate so that the fixing roller cleaning unit 44 is made to move away from the fixing roller.

At step s4, the image forming apparatus 50 conducts initialization. Here, the initialization of the image forming apparatus 50 indicates a set of preliminary operation in order that the image forming apparatus performs image formation. The preliminary operation includes removal of residual potential of the photoreceptor 65, temperature rising of the fixing roller up to a prescribed temperature, and the like. Since the initialization includes the initializing operation of the fixing apparatus 43, such as aforementioned temperature rising of the fixing roller up to a prescribed temperature, only operational steps concerning the initialization of the fixing apparatus 43 are shown as steps s41 to s43 in the step s4.

At step s41, as shown in the previous FIG. 9, the heater control power source 87 is turned on so that the temperature rising of the fixing roller starts. At step s42 is determined whether the temperature of the fixing roller is equal to or higher than a softening point of the developer or not. In a case of the image forming apparatus 50 in which the fixing apparatus 43 is mounted, this determination is conducted in a manner that the control portion 54 compares the detected output of the temperature sensor 82 to the softening temperature of the developer previously stored in the memory 88. The operation proceeds to step s43 when the temperature of the fixing roller is equal to or higher than the softening temperature of the developer whereas the step s42 is repeated when the temperature of the fixing roller is lower than the softening temperature of the developer, in other words, the temperature rising and detecting temperature of the fixing roller are repeatedly conducted until the temperature reaches the softening temperature. At step s43, the control portion 54 outputs an operational command to the propinquity/separation driving portion 35 so as to make the fixing roller cleaning unit 44 contact the fixing roller.

Next, the operation proceeds to step s5. At step s5 is determined whether the initialization of the apparatus has ended or not. This determination is conducted by the control portion 54 in accordance with an operational control program of the entire apparatus. When the initialization has not ended, the operation returns to the step s4 and when the initialization has ended, the operation proceeds to step s6.

At step s6, for instance, on the basis of the print request serving as an image forming command due to the operator, the print process serving as a set of the image forming process is executed in accordance with the operational control program. At step s7, on the basis of the detected output due to the photoreceptor rotation detecting means 84, the control portion 54 determines whether the photoreceptor 54 has stopped rotating or not. When the photoreceptor 65 has not stopped, the print process in the print request has not ended yet and therefore, the operation returns to the step s6 so that remaining print request is executed. When the photoreceptor 65 has stopped, the operation proceeds to step s8.

At step s8, when the preset base time t1 has elapsed since the halt of rotation of the photoreceptor 65, the control portion 54 brings the apparatus to the energy-saving mode. At step s9, the control portion 54 determines whether the apparatus has been brought to the energy-saving mode. When the energy-saving mode has not been brought, the step s9 is repeated and when the energy-saving mode has been brought, the operation proceeds to step s10. At step s10, the control portion 54 determines on the basis of the detected result of the temperature sensor 82 whether the temperature of the fixing roller is equal to or lower than the softening temperature of the developer or not. When the temperature of the fixing roller is equal to or lower than the softening temperature of the developer, the operation proceeds to step s11 and when the temperature of the fixing roller exceeds the softening temperature of the developer, the step s10 is repeated. At step s11, the control portion 54 outputs the operational command to the propinquity/separation driving portion 35 to operate so that the fixing roller cleaning unit 44 is made to move away from the fixing roller, and then the operation proceeds to End of step s12.

At the End of step s12 is brought a standby state that waits for next print request in the energy-saving mode, or the shut off mode that the main power is turned off and only standby electricity is supplied in a case where a time that is equal to or longer than the base time t2 has elapsed in the energy-saving mode. In a case where the print request is inputted in the standby state of the energy-saving mode in the End, the operation starts from the step s6 of the flow chart. On the other hand, in a case of being printed in the shut off mode in the End, the operation starts from the step s1 of the flow chart.

Further, in the image forming apparatus 50, the propinquity/separation mechanism 33 can make the fixing roller cleaning unit 44 contact the fixing roller in response to the print request, and the propinquity/separation mechanism 33 can move the fixing roller cleaning unit 44 away form the fixing roller in response to the end of the print process.

The control portion 54 serving as print request detecting means receives the print request inputted by, for instance, the operator from the input portion 81 serving as print request inputting means provided in the image forming apparatus 50. And then, the control portion 54 outputs the operational command to the propinquity/separation mechanism 33 so as to make the fixing roller cleaning unit 44 contact the fixing roller. The end of the print process serving as the image forming operation is detected by the print end detecting means. In response to the detected output, the control portion 54 outputs the operational command to the propinquity/separation mechanism 33 so that the fixing roller cleaning unit 44 is made to move away from the fixing roller.

In the image forming apparatus 50 according to the embodiment, the print end detecting means is configured by the discharge detecting means 85 and the timer portion 86. The discharge detecting means 85 is provided in the discharge unit 55, and detects the recording paper on which an image is formed by the image forming unit 53 and fixing process is performed by the fixing apparatus 43 and which is discharged to the discharge tray 77 of the discharge unit 55. The control portion 54 determines the end of the print process when next recording paper is not discharged in spite of the fact that a time counted by the timer portion 86 has passed the preset time after discharge of the recording paper to the discharge tray 77 of the discharge unit 55 is detected.

FIG. 11 is a flow chart for explaining the operational control over the propinquity/separation mechanism 33 due to the control portion 54 based on the print process. With reference to FIG. 11, there will be described the operational control over the propinquity/separation mechanism 33 due to the control portion 54 based on the print process. The flow chart of FIG. 11 is similar to the flow chart shown in FIG. 10 for explaining the operational control over the propinquity/separation mechanism 33 due to the control portion 54 based on a length of time that has elapsed since a halt of rotation of the photoreceptor 65, so that a description of a step indicating the same operation will be omitted.

The steps s0 to s3 are the same as those of the previous flow chart in FIG. 10. In the initialization of the apparatus at step s4, the fixing apparatus 43 performs only warm-up that heats the fixing roller, such as the temperature rising up to the softening temperature of the developer. The fixing apparatus 43 does not perform the operation that makes the fixing roller cleaning unit 44 contact the fixing roller. At step s5, the control portion 54 determines whether the initialization of the apparatus has ended or not. When the initialization has not ended, the operation returns to the step s4 and when the initialization has ended, the operation proceeds to the step s6.

At step s6, the control portion 54 serving as the print request detecting means determines whether the print request serving as the image forming command is inputted by, for instance, the operator or not. When the print request is detected, the operation proceeds to the step s22 and when the print request is not detected, the step s21 is repeated, in other words, the standby state that waits for the print request in the initialized state is brought.

At step s22, the control portion 54 determines whether the temperature of the fixing roller is equal to or higher than the softening point of the developer or not. When the temperature of the fixing roller is equal to or higher than the softening temperature of the developer, the operation proceeds to step s23. And then, the control portion 54 outputs the operational command to the propinquity/separation driving portion 35 so as to make the fixing roller cleaning unit 44 contact the fixing roller in order to enable the fixing process among the print process. When the temperature of the fixing roller is lower than the softening temperature of the developer, the step s22 is repeated, in other words, temperature rising of the fixing roller and detecting temperature of the fixing roller are repeatedly conducted until the temperature of the fixing roller reaches at least the softening temperature.

At step s24, the control portion 54 controls the operation so as to execute the print process in accordance with the operational control program of the image forming apparatus 50. At step s25, the control portion 54 determines whether the print process has ended or not, based on outputs of the discharge detecting means 85 serving as print end detecting means and the timer portion 86. When the print process has not ended, the operation returns to the step s24 in order to continue residual printing. When the print process has ended, the operation proceeds to the step s11 so that the fixing roller cleaning unit 44 is made to move away from the fixing roller. The step s11 and the End of step s12 are the same as those of the previous flow chart shown in FIG. 10.

Regarding whether the operation of the propinquity/separation mechanism 33 is controlled based on a length of time that has elapsed since the halt of rotation of the photoreceptor 65 or based on the print process, it is possible to selectively set among the operational control programs previously stored in the memory 88 as a basic operational setting of the image forming apparatus 50.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image forming apparatus comprising:

a photoreceptor exposed to light in accordance with image information so as to form an electrostatic latent image thereon;

developing means for attaching developer to the electrostatic latent image on the photoreceptor;

transferring means for transferring the developer on the photoreceptor onto a recording medium so that an image of the developer is formed on the recording medium; and a fixing apparatus for fusing and fixing the unfixed developer onto the recording medium by means of fixing rollers which form a pair of rotators, the recording medium on which the image of the unfixed developer is formed being passed through a pressure contact section formed by the fixing rollers, wherein the image forming apparatus further comprises:

photoreceptor rotation detecting means for detecting whether the photoreceptor rotates or not; and time counting means for counting a length of time that has elapsed since a halt of rotation of the photoreceptor detected by the photoreceptor rotation detecting means, wherein the fixing apparatus comprises:

a fixing roller cleaning unit for cleaning at least either surface of the fixing rollers; and propinquity/separation means for moving the fixing roller cleaning unit close to and away from the fixing rollers, wherein the fixing roller cleaning unit comprises:

a belt-shaped cleaning member provided so as to contact at least either of the fixing rollers, for cleaning a surface of the fixing roller;

a pressure-contact roller provided so as to press the cleaning member on the fixing roller which is in contact with the cleaning member;

a feeding roller for feeding the belt-shaped cleaning member which has been rolled up;

a winding roller for taking up the cleaning member which has been fed from the feeding roller so as to contact the fixing roller, and then cleaned the surface of the fixing roller; and guide rollers respectively provided between the feeding roller and the pressure-contact roller, and between the pressure-contact roller and the winding roller, so as to contact the cleaning member, wherein the belt-shaped cleaning member, the pressure-contact roller, the feeding roller, the winding roller, and the guide rollers constitute an integrally-disposed unit, and the integrally-disposed unit is moved so as to be close to and away from the fixing rollers; and wherein when a counted time by the time counting means becomes a predetermined value, the propinquity/separation means moves the fixing roller cleaning unit away from the fixing roller.

* * * * *